US008836745B2

(12) United States Patent
Sato

(10) Patent No.: US 8,836,745 B2
(45) Date of Patent: Sep. 16, 2014

(54) IMAGE FORMING APPARATUS

(75) Inventor: Kengo Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 13/447,707

(22) Filed: Apr. 16, 2012

(65) Prior Publication Data

US 2012/0269552 A1 Oct. 25, 2012

(30) Foreign Application Priority Data

Apr. 20, 2011 (JP) ..... 2011-093635

(51) Int. Cl.
*B41J 2/435* (2006.01)
*B41J 27/00* (2006.01)
*G03G 15/04* (2006.01)

(52) U.S. Cl.
CPC ..... *G03G 15/04054* (2013.01)
USPC ..... 347/245; 347/263; 347/256; 347/257

(58) Field of Classification Search
USPC ..... 347/256–258, 263, 245
See application file for complete search history.

(56) References Cited

U.S. PATENT DOCUMENTS

2009/0220272 A1* 9/2009 Mikami et al. ..... 399/111
2010/0238257 A1* 9/2010 Sakamoto ..... 347/224

FOREIGN PATENT DOCUMENTS

JP 2004240112 A * 8/2004
JP 2005335074 A * 12/2005 ..... B41J 2/44
JP 2006082522 A * 3/2006

* cited by examiner

*Primary Examiner* — Sarah Al Hashimi
(74) *Attorney, Agent, or Firm* — Fitzpatrick, Cella, Harper & Scinto

(57) ABSTRACT

An image forming apparatus includes an image bearing member, an exposure device including a plurality of light emitting elements, and a holding member configured to hold the exposure device at a mounting portion between first positioning members provided at both longitudinal end portions of the exposure device. In addition, a second positioning member positions the holding member relative to the image bearing member so as to position the exposure device relative to the image bearing member at the mounting portion, a second elastic member urges the holding member toward the image bearing member so as to maintain a positioned state of the second positioning member, and first and second adjusting members adjusts a distance in a direction of an optical axis between the image bearing member and the exposure device at both longitudinal end portions and at the mounting portion of the exposure device. The holding member has a rigidity necessary to curve the exposure device in the longitudinal direction when the second adjusting member adjusts a distance in the direction of the optical axis between the image bearing member and the exposure device at the mounting portion of the exposure device.

8 Claims, 12 Drawing Sheets

IMAGE FORMING APPARATUS

BACKGROUND OF THE INVENTION

1. Field of the Invention

The present invention relates to an image forming apparatus including a light emitting member provided with a plurality of light emitting elements which expose an image bearing member with light.

2. Description of the Related Art

Conventionally, an electrophotographic image forming apparatus, such as a digital copying machine and printer, generally employs a semiconductor laser as an exposure light source. A light beam emitted from the semiconductor laser is deflected by a light deflector including a rotating polygon mirror. The deflected light beam is imaged and scanned on a surface of a photosensitive drum via an fθ lens, and an electrostatic latent image is formed on the surface of the photosensitive drum.

On the other hand, many image forming apparatus available in recent years employ a light emitting diode array (hereinafter, referred to as "LED array") as the exposure light source. The LED array includes a plurality of light emitting diodes (hereinafter, referred to as "LEDs") arrayed in line. The LED array is held by an LED head. A plurality of light beams emitted from the LED array are each imaged on the surface of the photosensitive drum via a rod lens array, and an electrostatic latent image is formed on the surface of the photosensitive drum.

In general, a conjugation length of the LED array is about 10 mm. The LED array is an optical system which is easily affected by deviation of a focus position from the surface of the photosensitive drum in a direction of an optical axis, as compared to a laser optical system having a relatively large focal length. Thus, it is necessary to accurately maintain a constant distance between the photosensitive drum serving as an image bearing member and the LED head holding the LED array.

Japanese Patent Application Laid-Open No. 2005-335074 discloses an image forming apparatus including an automatic adjusting device for automatically adjusting the distance between the photosensitive drum and the LED head with use of a motor, and a measurement device for measuring a deviation amount of an imaging position through measurement of density of a measurement pattern recorded on a recording medium. Based on a measurement result from the measurement device, the automatic adjusting device displaces adjusting members provided at both end portions of the LED head, to thereby adjust the distance between the LED head and the photosensitive drum. According to the configuration disclosed in Japanese Patent Application Laid-Open No. 2005-335074, the LED head can be positioned with high accuracy and without an adverse effect of changes with the passage of time.

Further, the image forming apparatus disclosed in Japanese Patent Application Laid-Open No. 2005-335074includes a pressing device for pressing a longitudinal center portion of the LED head to adjust the distance between the LED head and the image bearing member. The LED head initially has a projecting shape, in which the longitudinal center portion thereof is spaced away from the image bearing member as compared to the end portions thereof. The pressing device adjusts a pressing force to be applied to the center portion of the LED head, to thereby adjust the distance between the LED head and the image bearing member. Accordingly, even an LED head having a large width can be positioned with high accuracy over the entire width of the LED print head so that the LED head can be mounted to the image forming apparatus.

However, it is extremely difficult to adjust the distance between the LED head and the image bearing member for positioning over the entire range of an exposure width with high accuracy, and ensure the positioned state over a long period of time. In the configuration disclosed in Japanese Patent Application Laid-Open No. 2005-335074, even when the LED head can initially be positioned with high accuracy through the adjustment at the time of assembly, the positioned state cannot be maintained with high accuracy in some cases due to adverse effects of vibrations that may occur after the positioning, physical distribution, and long-term use.

SUMMARY OF THE INVENTION

An image forming apparatus according to an exemplary embodiment of the present invention includes: an image bearing member; an exposure device including a plurality of light emitting elements arrayed along a longitudinal direction of the image bearing member so as to expose with light different positions of the image bearing member in the longitudinal direction; first positioning members provided at both longitudinal end portions of the exposure device, and configured to position the exposure device relative to the image bearing member at both the longitudinal end portions, respectively; a first elastic member configured to urge the exposure device toward the image bearing member so as to maintain a positioned state of the first positioning members; a holding member configured to hold the exposure device at a mounting portion between the first positioning members provided at both the longitudinal end portions of the exposure device; a second positioning member provided on the holding member, and configured to position the holding member relative to the image bearing member so as to position the exposure device relative to the image bearing member at the mounting portion; and a second elastic member configured to urge the holding member toward the image bearing member so as to maintain a positioned state of the second positioning member.

According to the exemplary embodiment of the present invention, the exposure device can be positioned with high accuracy relative to the image bearing member over the entire longitudinal range of the exposure device, and the adverse effects to be imposed on the positioned state from the vibrations, physical distribution, and long-term use can be reduced.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the attached drawings.

(First Embodiment)

Figure 1:
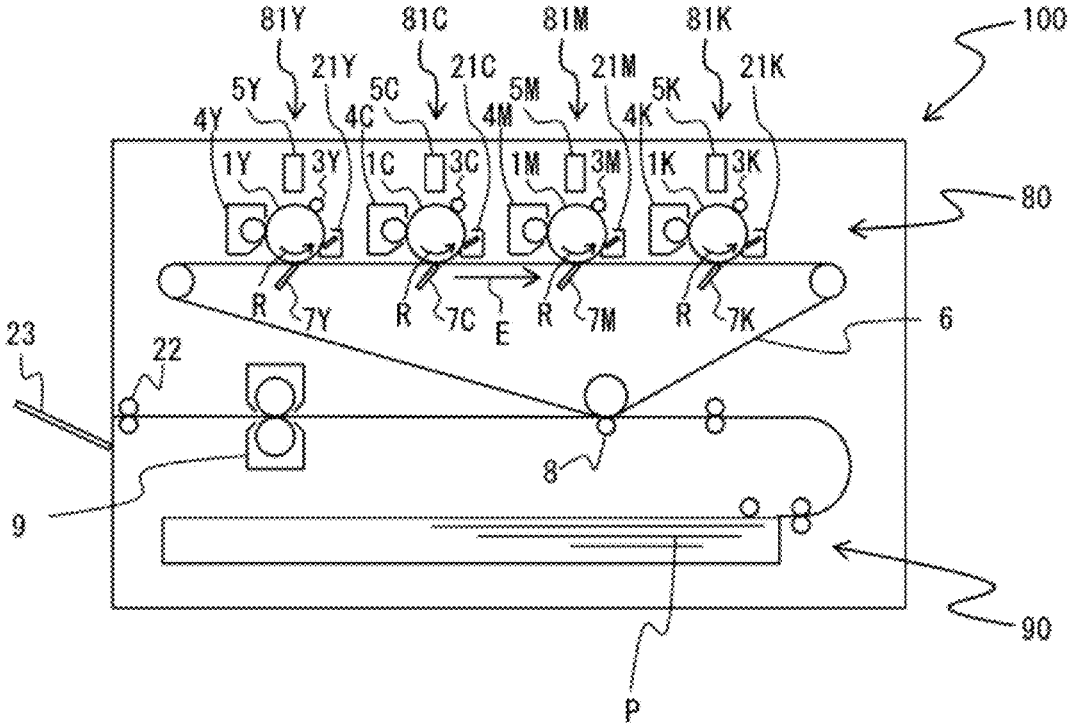
FIG. 1 is a schematic sectional view of an image forming apparatus according to a first embodiment of the present invention.

FIG. 1 is a schematic sectional view of an image forming apparatus 100 according to a first embodiment of the present invention. The image forming apparatus 100 includes an image forming portion 80, and a feeding portion 90 which feeds a sheet (recording medium) P to the image forming portion 80.

The image forming portion 80 includes four image forming stations 81 (81Y, 81C, 81M, and 81K) arranged in tandem, an intermediate transfer belt (intermediate transfer member) 6, and a fixing device 9. The image forming stations 81 include photosensitive drums (image bearing members) 1 (1Y, 1C, 1M, and 1K), respectively. The photosensitive drums 1 rotate in a direction indicated by the arrows R. Around each photosensitive drum 1, a charging device 3, an LED head (exposure device) 5, a developing device 4, a primary transfer member 7, and a cleaning device 21 are provided.

The charging devices 3 (3Y, 3C, 3M, and 3K) uniformly charge surfaces of the photosensitive drums 1 (1Y, 1C, 1M, and 1K), respectively. The LED heads 5 (5Y, 5C, 5M, and 5K) expose the uniformly charged surfaces of the photosensitive drums 1 with light in accordance with an input image signal, to thereby form electrostatic latent images on the surfaces of the photosensitive drums 1, respectively. The developing devices 4 (4Y, 4C, 4M, and 4K) develop the electrostatic latent images on the surfaces of the photosensitive drums 1 into toner images with use of developer (toner), respectively.

The developing device 4Y contains yellow developer (yellow toner). The developing device 4Y forms a yellow toner image on the surface of the photosensitive drum 1Y. The developing device 4C contains cyan developer (cyan toner). The developing device 4C forms a cyan toner image on the surface of the photosensitive drum 1C. The developing device 4M contains magenta developer (magenta toner). The developing device 4M forms a magenta toner image on the surface of the photosensitive drum 1M. The developing device 4K contains black developer (black toner). The developing device 4K forms a black toner image on the surface of the photosensitive drum 1K.

The intermediate transfer belt 6 is held in contact with the photosensitive drums 1, and rotates in a direction indicated by the arrow E.

The primary transfer members 7 (7Y, 7C, 7M, and 7K) transfer the toner images on the surfaces of the photosensitive drums 1 onto the intermediate transfer belt 6, respectively. The cyan toner image is superimposed on the yellow toner image on the intermediate transfer belt 6. The magenta toner image is superimposed on the cyan toner image. The black toner image is superimposed on the magenta toner image.

The four toner images sequentially superimposed on the intermediate transfer belt 6 are transferred by a secondary transfer roller 8 onto the sheet P that is fed from the feeding portion 90.

The toner images on the sheet P are fixed to the sheet by the fixing device 9, and accordingly an image is formed on the sheet P. The sheet P having the image formed thereon is delivered onto a delivery tray 23 by delivery rollers 22.

Next, referring to FIG. 2, the LED head 5 used in the image forming apparatus 100 of the first embodiment will be described in detail.

Figure 2:
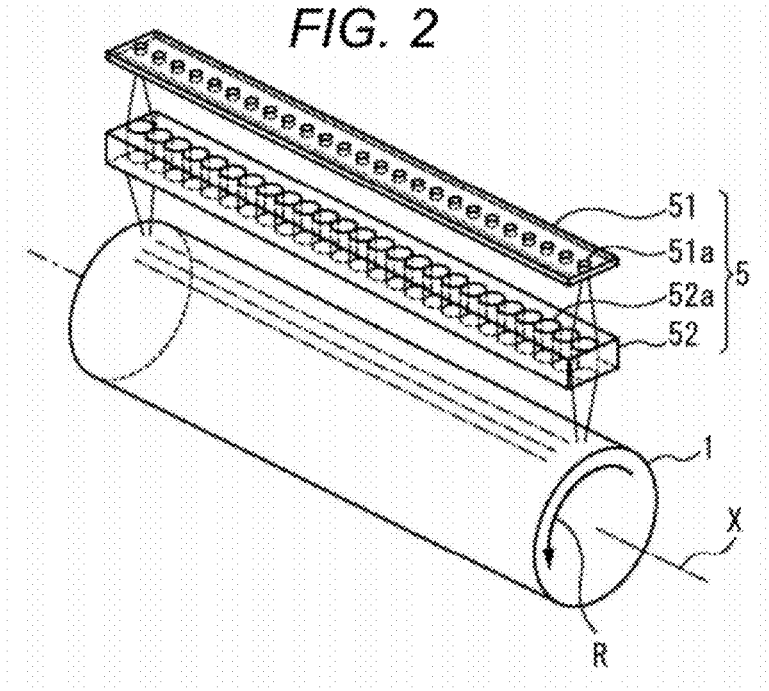
FIG. 2 is a perspective view of an LED head.

FIG. 2 is a perspective view of the LED head 5. As illustrated in FIG. 2, the photosensitive drum 1 rotates in the direction indicated by the arrow R about an axis X.

The LED head 5 has an elongated shape extending in a longitudinal direction parallel to the axis X of the photosensitive drum 1. The LED head 5 includes an LED array (light emitting element array) 51, and a rod lens array (imaging element array) 52.

The LED array 51 includes a plurality of LEDs (light emitting elements) 51*a* arranged side-by-side along the axis X of the photosensitive drum 1. In the first embodiment, the plurality of LEDs 51*a* are arranged in a straight line. That is, the LED head 5 includes the plurality of LEDs 51*a* provided side-by-side along the axis (longitudinal direction) X of the photosensitive drum 1, for emitting light in accordance with image information to expose the surface of the photosensitive drum 1 with light.

Figure 3:
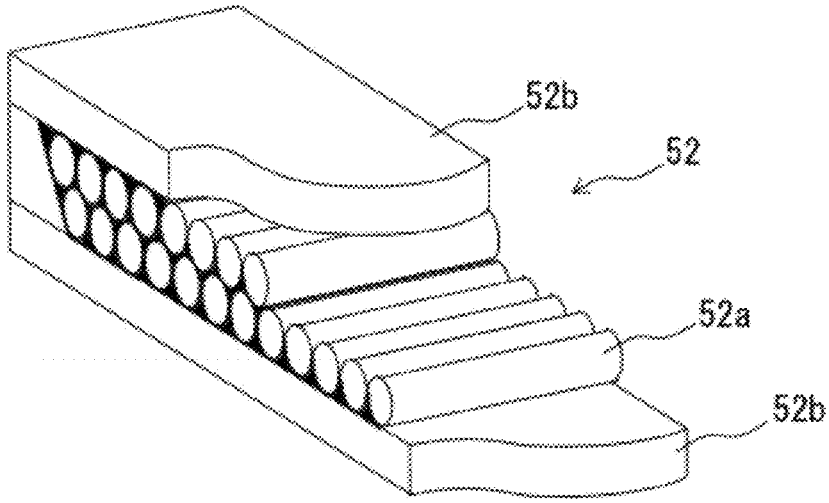
FIG. 3 is a partial sectional perspective view of a rod lens array.

The rod lens array 52 includes a plurality of rod lenses (imaging elements) 52*a* arranged side-by-side along the axis X of the photosensitive drum 1. FIG. 3 is a partial sectional perspective view of the rod lens array 52. The rod lens array 52 includes the plurality of rod lenses 52*a* arranged in two straight lines between two plates 52*b*. The rod lenses 52*a* are each an erecting equal-magnification imaging lens. The rod lenses 52*a* condense light emitted from the LEDs 51*a*, to thereby form an image at the same magnification on the surface of the photosensitive drum 1. In the first embodiment, the LED array 51 and the rod lens array 52 are integrated to constitute the LED head 5 as an exposure light source.

The plurality of LEDs 51*a* of the LED array 51 are caused to emit light selectively while the photosensitive drum 1 is rotated in the direction indicated by the arrow R. Accordingly, a two-dimensional electrostatic latent image is formed on the surface of the photosensitive drum 1.

Figure 4:
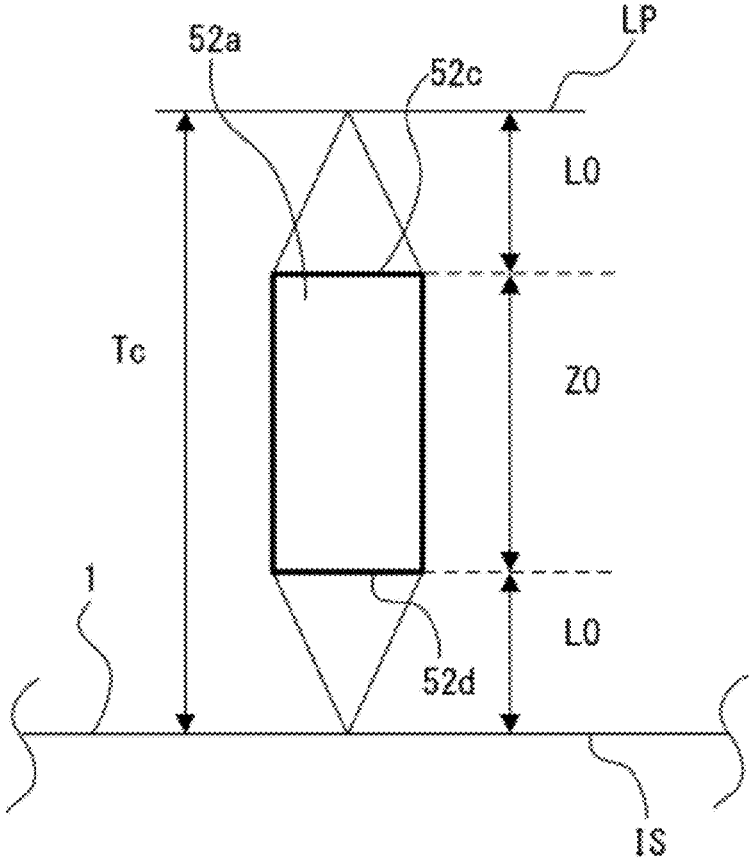
FIG. 4 is an explanatory view illustrating a rod lens.

FIG. 4 is an explanatory view illustrating the rod lens 52*a*. In FIG. 4, the symbol L0 represents a working distance from the LED (light emitting point LP) as an object to an end surface 52*c* of the rod lens 52*a*. The symbol Z0 represents a length of the rod lens 52*a*. The symbol L0 further represents a working distance from the surface of the photosensitive drum 1 (image surface IS) to an end surface 52*d* of the rod lens 52*a*. A conjugation length Tc of the rod lens 52*a* is expressed by Tc=Z0+2×L0.

Image transmission characteristics of the rod lens array 52 are evaluated based on quality of the transmitted image or a resolving power of the rod lens array 52. The image transmission characteristics are evaluated with use of a modulation transfer function (hereinafter, referred to as "MTF").

Figure 5:
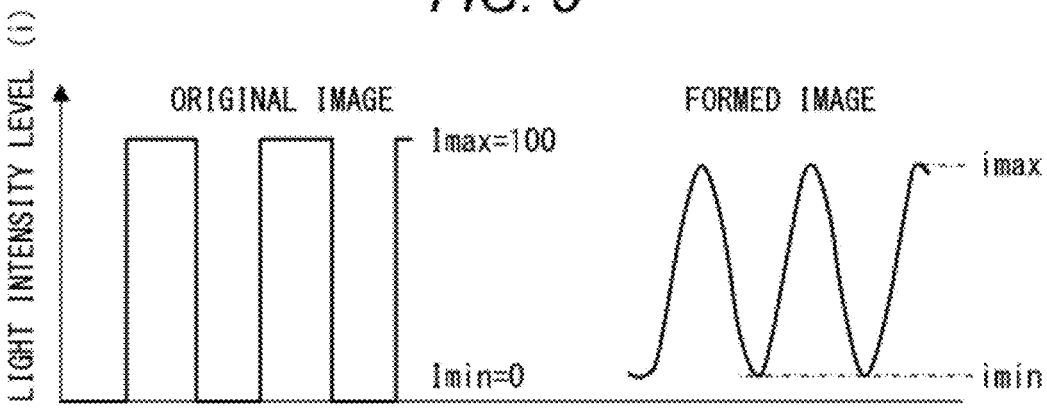
FIG. 5 is an explanatory graph showing evaluation with use of a modulation transfer function (MTF).

FIG. 5 is an explanatory graph showing the evaluation with use of the MTF. When taking as an example a case where an original image in a rectangular wave pattern shown in FIG. 5 is formed through the rod lens array 52, the MTF serves as a measure of how closely the formed image is reproduced relative to the original image. The value of the MTF in the image of FIG. 5 is defined as follows:

$$\mathrm{MTF}(w)=(i(w)\max-i(w)\min)/(i(w)\max+i(w)\min)\times 100\%$$

where i(w)max and i(w)min represent the maximum and the minimum of rectangular wave response at a spatial frequency w (lp/mm), respectively. As the value of the MTF is closer to 100%, an image is reproduced more closely to the original image.

The value of the MTF greatly varies depending on a case of measurement at a focus position of the rod lens array 52 and a case of measurement at a position deviating from the focus position. Further, the conjugation length Tc of the rod lens 52*a* is generally about 10 mm, and hence the LED head 5 is easily affected by the deviation of the focus position as compared to a laser optical system having a relatively large focal length. Thus, it is necessary to always maintain a constant distance between the photosensitive drum 1 and the LED head 5.

In the first embodiment, the LED array 51 has an element density (resolution) of 600 dpi. The LED has an electrode size of about 20 micrometers (μm). In the first embodiment, the rod lens 52*a* has a diameter of about 0.6millimeters (mm). As illustrated in FIG. 3, the rod lens array 52 includes the plurality of rod lenses 52*a* arranged in two lines.

At this time, the conjugation length Tc of the rod lens array 52 is about 9.9 millimeters. As illustrated in FIG. 4, the conjugation length Tc corresponds to a distance from the light emitting point LP to the image surface.

However, the distance between the LED (light emitting point LP) 51*a* and the surface of the photosensitive drum 1 (image surface IS) is liable to fluctuate due to various factors.

For example, the distance between the LED (light emitting point LP) 51*a* and the surface of the photosensitive drum 1 (image surface IS) fluctuates due to adverse effects such as warpage of the LED head 5, a positioning error at the time of assembly, and deformation and positional deviation of the LED head 5 that may occur along with an environmental change and physical distribution.

In the first embodiment, an allowable range of the distance fluctuation is set to 9.9 millimeters with a margin of error of ±50 micrometers for a satisfactory image. This allowable range is a general numerical value as described in Japanese Patent Application Laid-Open No. 2004-240112.

When the fluctuation in distance between the LED (light emitting point LP) 51*a* and the surface of the photosensitive drum 1 (image surface IS) exceeds the allowable range, a coarse, low-quality image is output in many cases. The sense of coarseness (sense of graininess) arises when the value of the MTF decreases and a spot profile changes.

Figure 6A:
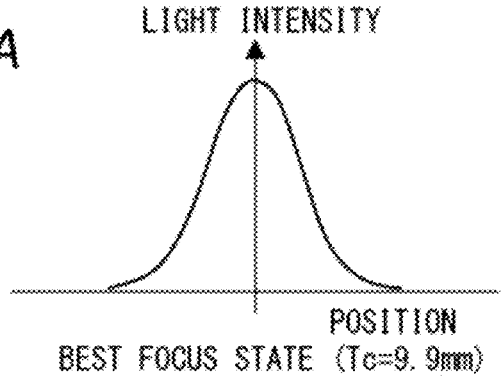
FIGS. 6A and 6B are graphs showing spot profiles.
Figure 6B:
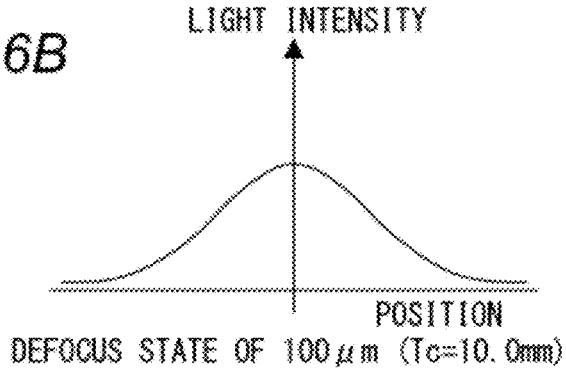

FIGS. 6A and 6B are graphs showing spot profiles.

FIG. 6A is a graph showing a spot profile in the best focus state. In FIG. 6A, the distance between the LED (light emitting point LP) 51*a* and the surface of the photosensitive drum 1 (image surface IS) is 9.9 millimeters, which is the conjugation length Tc. FIG. 6A shows a spot profile in an ideal imaging plane.

FIG. 6B is a graph showing a spot profile in the defocus state. In FIG. 6B, the distance between the LED (light emitting point LP) 51*a* and the surface of the photosensitive drum 1 (image surface IS) is 10.0 millimeters. FIG. 6B shows a spot profile at a position spaced by 100 micrometers from the ideal imaging plane. The spot profile at a position spaced by 100 micrometers from the ideal imaging plane shows a distribution with low light intensity and spreading end portions of the spots.

Adverse effects to be imposed in a case where the light intensity decreases will be described below.

Figure 7A:
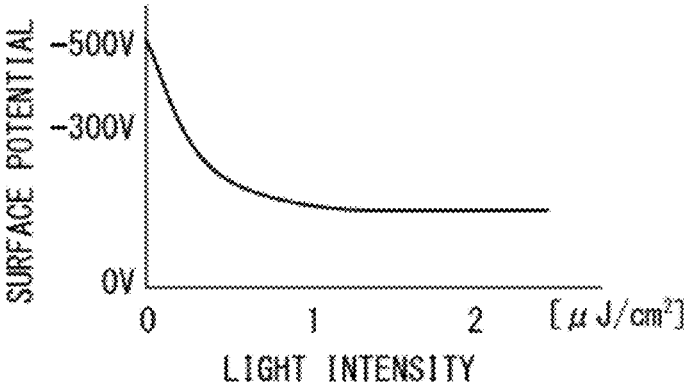
FIGS. 7A and 7B are graphs showing characteristics of a photosensitive drum and development characteristics.
Figure 7B:
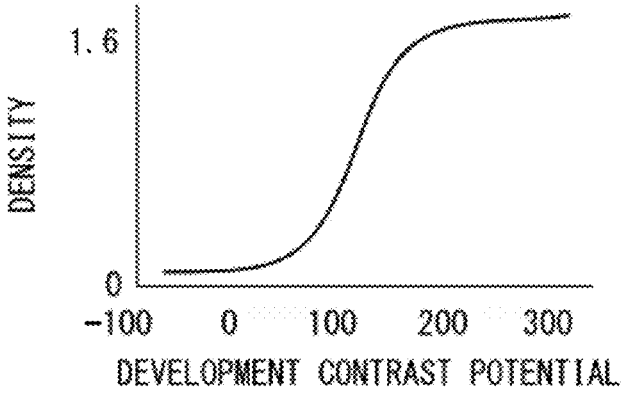

FIGS. 7A and 7B are graphs showing characteristics of the photosensitive drum 1 and development characteristics.

FIG. 7A is a graph showing a relationship of a surface potential of the photosensitive drum 1 relative to the light intensity. As can be seen from FIG. 7A, in a range of low light intensity, the surface potential of the photosensitive drum 1 steeply decreases along with increase in light intensity. That is, the photosensitive drum 1 has such characteristics that, in the range of low light intensity, the change in surface potential of the photosensitive drum 1 is greater relative to the change in light intensity.

FIG. 7B is a graph showing a relationship of toner density relative to a development contrast potential in electrophotographic image formation. As can be seen from FIG. 7B, in a range of middle development contrast potential, the density steeply increases along with increase in development contrast potential. That is, in the range of middle development contrast potential, the change in density is greater relative to the change in development contrast potential. Therefore, in the range of middle development contrast potential, a low-quality image is liable to be formed.

Therefore, it is necessary to prevent the fluctuation in distance between the LED 51*a* and the surface of the photosensitive drum 1 due to the adverse effects of disturbance such as vibrations, physical distribution, and endurance.

Printer output characteristics in the best focus state and the defocus state will be described below.

Figure 8:
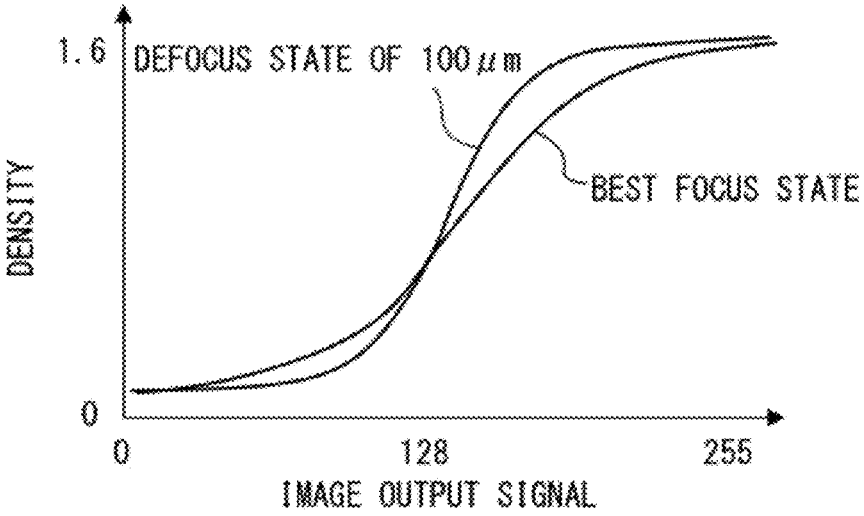
FIG. 8 is a graph showing a relationship of toner density relative to an image output signal.

FIG. 8 is a graph showing a relationship of the toner density relative to an image output signal. FIG. 8 shows printer output characteristics obtained based on the spot profiles of FIGS. 6A and 6B, an E-V characteristic, which is a characteristic indicating a potential decay amount relative to the exposure light intensity of the photosensitive drum 1, and a V-D characteristic, which is a difference between a direct-current potential of a development bias applied to the developing device 4 and a potential of the latent image.

The reason for the difference between the printer output characteristic in the defocus state and the printer output characteristic in the best focus state will be described below.

Figure 9A:
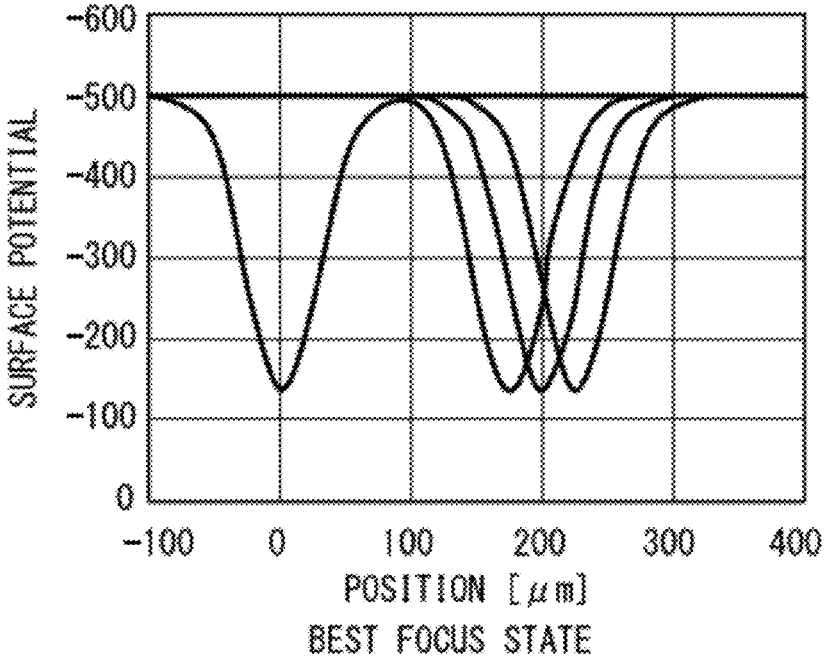
FIGS. 9A and 9B are graphs showing surface potentials of a latent image of a single dot and a latent image of a plurality of dots.
Figure 9B:
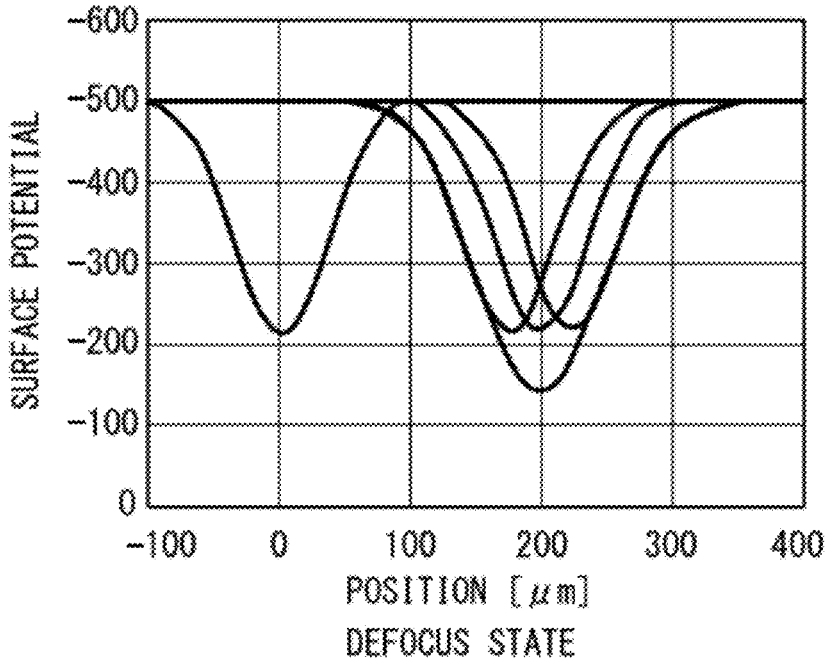

FIGS. 9A and 9B are graphs showing surface potentials of a latent image of a single dot and a latent image of a plurality of dots. FIGS. 9A and 9B schematically show surface potentials of latent images of a single dot and a plurality of dots obtained based on the spot profiles of FIGS. 6A and 6B, and the above-mentioned E-V characteristic and V-D characteristic.

FIG. 9A is a graph showing surface potentials of latent images of a single dot and a plurality of dots on the surface of the photosensitive drum 1 in the best focus state. In the best focus state, both the single dot and the plurality of dots are reproduced on a dot basis.

FIG. 9B is a graph showing surface potentials of latent images of a single dot and a plurality of dots on the surface of the photosensitive drum 1 in the defocus state.

In the defocus state, the light intensity is low and a wide latent image is formed. Therefore, the single dot is not reproduced and the dot is reproduced at a position at which the plurality of dots overlap. As a result, as the printer output characteristic, the density of a highlighted portion is low, and the density steeply increases in medium tones, in which the overlap of the dots occurs. Accordingly, the change in density becomes greater relative to the image output signal (the slope of the curve becomes steeper). Thus, in the defocus state, there arises a problem with tone number and stability.

Further, due to the fact that the single dot is not reproduced and the dot is reproduced only at a position at which the dots overlap, the sense of coarseness arises in the medium tones, in which the single dot and the plurality of dots are mixed.

In the best focus state, both the single dot and the plurality of dots are reproduced, and through macroscopic observation, the image is recognized as an image having a uniform density. However, in the defocus state, the single dot is not reproduced, and hence only the portion with the overlap of the plurality of dots is recognized. Even through the macroscopic observation, the portion with the overlap of the plurality of dots is highly visible, resulting in a coarse image.

In order to prevent the coarse image as described above, the image forming apparatus of the first embodiment includes a positioning portion which positions the LED head with high accuracy and is difficult to change the position even through the lapse of time.

The positioning of the LED head 5 relative to the photosensitive drum 1 will be described below.

Figure 10A:
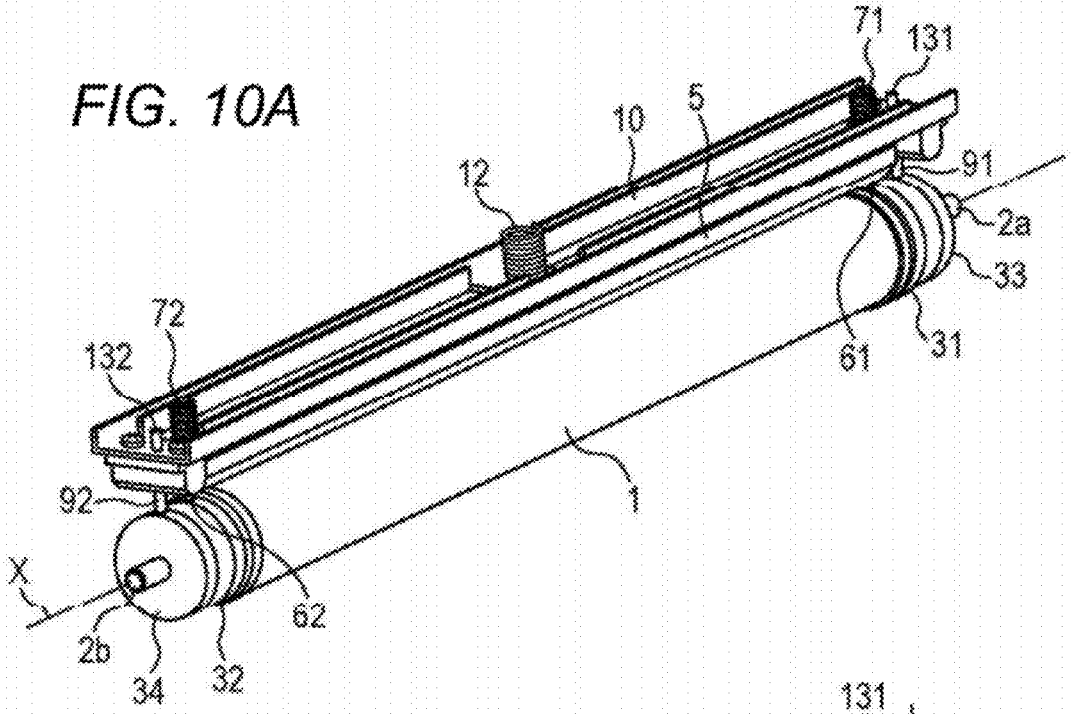
FIGS. 10A and 10B are perspective views of a positioning portion which positions the LED head relative to the photosensitive drum according to the first embodiment.
Figure 10B:
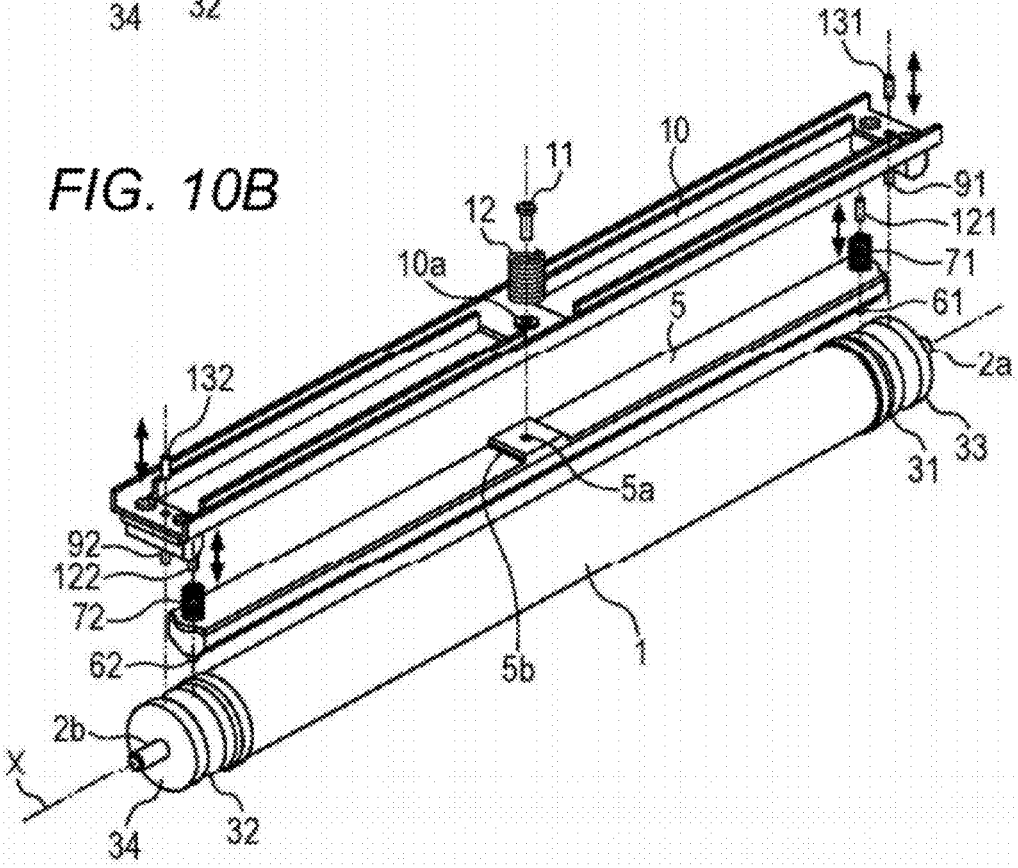

FIGS. 10A and 10B are perspective views of the positioning portion which positions the LED head 5 relative to the photosensitive drum 1 according to the first embodiment. The positioning portion includes a first inner cylindrical abutment portion 31, a second inner cylindrical abutment portion 32, a first outer cylindrical abutment portion 33, a second outer cylindrical abutment portion 34, a first inner positioning pin 61, a second inner positioning pin 62, a first outer positioning pin 91, and a second outer positioning pin 92. The positioning portion further includes a spring member 12, a spring member 71, a spring member 72, and a screw 11.

At both end portions of the photosensitive drum 1, rotation shafts 2*a* and 2*b* which rotatably support the photosensitive drum 1 are provided on the axis X of the photosensitive drum 1.

The rotation shaft 2*a* at one end portion of the photosensitive drum 1 is provided with the two cylindrical abutment portions 31 and 33 that are coaxial with the rotation shaft 2*a*. The two cylindrical abutment portions and 33 comprise the first inner cylindrical abutment portion 31 and the first outer cylindrical abutment portion 33.

The first inner cylindrical abutment portion 31 and the first outer cylindrical abutment portion 33 are coaxial with the photosensitive drum 1. The outer diameters of the first inner cylindrical abutment portion 31 and the first outer cylindrical abutment portion 33 are preferred to be equal to the outer diameter of the photosensitive drum 1. When those outer diameters are equal, the positioning described later can be facilitated. However, the present invention is not limited thereto, and the outer diameters of the first inner cylindrical abutment portion 31, the first outer cylindrical abutment portion 33, and the photosensitive drum 1 may be different from one another.

In the first embodiment, the first inner cylindrical abutment portion 31 and the first outer cylindrical abutment portion 33 are provided on the rotation shaft 2*a*, but the present invention is not limited thereto. The first inner cylindrical abutment portion 31 and the first outer cylindrical abutment portion 33 may be provided directly on the one end portion of the photosensitive drum 1.

In the first embodiment, the first inner cylindrical abutment portion 31 and the first outer cylindrical abutment portion 33 are provided separately from each other. However, the first inner cylindrical abutment portion 31 and the first outer cylindrical abutment portion 33 may be adjoined to each other.

The first inner cylindrical abutment portion 31 and the first outer cylindrical abutment portion 33 may be configured to function as a bearing portion which rotatably supports the photosensitive drum 1.

Similarly, the rotation shaft 2*b* at the other end portion of the photosensitive drum 1 is provided with the two cylindrical abutment portions 32 and 34 that are coaxial with the rotation shaft 2*b*. The two cylindrical abutment portions 32 and 34 comprise the second inner cylindrical abutment portion 32 and the second outer cylindrical abutment portion 34.

The second inner cylindrical abutment portion 32 and the second outer cylindrical abutment portion 34 are coaxial with the photosensitive drum 1. The outer diameters of the second inner cylindrical abutment portion 32 and the second outer cylindrical abutment portion 34 are preferred to be equal to the outer diameter of the photosensitive drum 1. When those outer diameters are equal, the positioning described later can be facilitated. However, the present invention is not limited thereto, and the outer diameters of the second inner cylindrical abutment portion 32, the second outer cylindrical abutment portion 34, and the photosensitive drum 1 may be different from one another.

In the first embodiment, the second inner cylindrical abutment portion 32 and the second outer cylindrical abutment portion 34 are provided on the rotation shaft 2*b*, but the present invention is not limited thereto. The second inner cylindrical abutment portion 32 and the second outer cylindrical abutment portion 34 may be provided directly on the other end portion of the photosensitive drum 1.

In the first embodiment, the second inner cylindrical abutment portion 32 and the second outer cylindrical abutment portion 34 are provided separately from each other. However, the second inner cylindrical abutment portion 32 and the second outer cylindrical abutment portion 34 may be adjoined to each other.

The second inner cylindrical abutment portion 32 and the second outer cylindrical abutment portion 34 may be configured to function as a bearing portion which rotatably supports the photosensitive drum 1.

At both longitudinal end portions of the LED head 5, the first inner positioning pin (first positioning member) 61 and the second inner positioning pin (first positioning member) 62 are provided, respectively. The first inner positioning pin 61 and the second inner positioning pin 62 position the LED head 5 relative to the photosensitive drum 1 at both the respective end portions of the LED head 5.

The first inner positioning pin 61 is provided at one longitudinal end portion of the LED head 5. The second inner positioning pin 62 is provided at the other longitudinal end portion of the LED head 5. The first inner positioning pin 61 and the second inner positioning pin 62 protrude from the LED head 5 in the direction of the optical axis, and abut against the first inner cylindrical abutment portion 31 and the second inner cylindrical abutment portion 32, respectively.

The protrusion amount of the first inner positioning pin 61 and the protrusion amount of the second inner positioning pin 62 are each adjustable.

The first inner positioning pin 61 and the second inner positioning pin 62 are inserted from one end portions of through holes (not shown) provided at both the end portions of the LED head 5, respectively. Adjusting screws (first adjusting members) 121 and 122 are provided at the other end portions of the through holes (not shown), respectively.

The adjusting screws 121 and 122 are rotated and accordingly the first inner positioning pin 61 and the second inner positioning pin 62 are vertically moved independently. Thus, the protrusion amount of the first inner positioning pin 61 and the protrusion amount of the second inner positioning pin 62 are adjusted independently.

At both the longitudinal end portions of the LED head 5, the spring members (first elastic members) 71 and 72 are provided. The spring members 71 and 72 urge the LED head 5 toward the photosensitive drum 1 so as to maintain the positioned state of the first inner positioning pin 61 and the second inner positioning pin 62.

The spring member 71 is provided in the vicinity of the first inner positioning pin 61 at the one end portion of the LED head 5. The spring member 72 is provided in the vicinity of the second inner positioning pin 62 at the other end portion of the LED head 5.

The spring members 71 and 72 are arranged between the LED head 5 and a support member (not shown) provided in the main body of the image forming apparatus 100 so as to support the LED head 5. The spring members 71 and 72 urge both the end portions of the LED head 5 toward the photosensitive drum 1 so that the first inner positioning pin 61 and the second inner positioning pin 62 abut against the first inner cylindrical abutment portion 31 and the second inner cylindrical abutment portion 32, respectively.

The adjusting screws 121 and 122 are rotated in the state in which the first inner positioning pin 61 and the second inner positioning pin 62 abut against the first inner cylindrical abutment portion 31 and the second inner cylindrical abutment portion 32, respectively, by the spring members 71 and 72. Through the rotation of the adjusting screws 121 and 122, the protrusion amount of the first inner positioning pin 61 and the protrusion amount of the second inner positioning pin 62 are adjusted independently. Accordingly, at both the end portions of the LED head 5, the distance between the photosensitive drum 1 and the LED head 5 is set to a first setting value (first distance).

When the distance between the photosensitive drum 1 and the LED head 5 is set to the first setting value, the distance in the direction of the optical axis between the LED 51*a* and the surface of the photosensitive drum 1 is set within the allowable range of the conjugation length Tc, which is 9.9 millimeters with a margin of error of ±50micrometers. Thus, both the end portions of the LED head 5 are positioned with high accuracy in the direction of the optical axis relative to the photosensitive drum 1.

The direction of the optical axis herein refers to a direction parallel to the optical axes of the plurality of rod lenses 52*a* of the rod lens array 52, and perpendicular to the axis X of the photosensitive drum 1.

The first inner positioning pin 61 and the second inner positioning pin 62 abut against the first inner cylindrical abutment portion 31 and the second inner cylindrical abutment portion 32, respectively, by the spring members 71 and 72 with an appropriate pressing force. Thus, the deviation due to an initial error at the time of assembly that is caused by the adverse effects such as a tolerance on components is corrected with high accuracy, with the result that the LED head 5 can be positioned relative to the photosensitive drum 1.

The first inner positioning pin 61 and the second inner positioning pin 62 can be always maintained in the state of abutting against the first inner cylindrical abutment portion 31 and the second inner cylindrical abutment portion 32, respectively, by the spring members 71 and 72. With the configuration in which the abutting state is maintained by the spring members 71 and 72, the positioned state is not easily affected by the disturbance such as vibrations, physical distribution, and endurance, and the distance between the photosensitive drum 1 and the LED head 5 can be maintained at the first setting value with high accuracy over a long period of time.

In this embodiment, the spring members 71 and 72 are coil springs. However, an elastic member such as a flat spring, a rubber member, and a foamed member may be used in lieu of the coil spring.

A holding member 10 holds the LED head 5. Similarly to the LED head 5, the holding member 10 has an elongated shape extending in the longitudinal direction parallel to the axis X of the photosensitive drum 1. The LED head 5 is held by the holding member 10 so that the longitudinal direction of the LED head 5 matches with the longitudinal direction of the holding member 10. The LED head 5 is arranged in parallel to the holding member 10. The holding member 10 is formed to have a high rigidity.

The LED head 5 is held by the holding member 10 at a mounting portion, which is provided at a given position between the first inner positioning pin 61 and the second inner positioning pin 62 provided at both the end portions of the LED head 5. In the first embodiment, the LED head 5 is fixed to the holding member 10 with the screw 11 at a mounting portion corresponding to a substantially longitudinal center portion of the LED head 5.

A threaded hole 5*a* is provided at the substantially longitudinal center portion of the LED head 5. A projecting portion 5*b* (mounting portion) is provided at the substantially longitudinal center portion of the LED head 5. The threaded hole 5*a* is provided in the projecting portion 5*b*. A hole 10*a* is provided at a substantially longitudinal center portion of the holding member 10. The screw 11 threadedly engages with the threaded hole 5*a* of the LED head 5 through the hole 10*a* of the holding member 10. The screw 11 fixes the center portion of the LED head to the center portion of the holding member 10. The projecting portion 5*b* of the LED head 5 abuts against a bottom surface of the holding member 10.

The center portion of the LED head 5 is fixed to the holding member 10 with the screw 11, and hence the center portion of the LED head 5 moves in the direction of the optical axis through movement of the holding member 10 in the direction of the optical axis. The holding member is formed to have a sufficiently higher rigidity than the LED head 5. Thus, when the holding member 10 is moved in the direction of the optical axis, the holding member 10 is not deformed and the LED head 5 is curved so that the center portion of the LED head 5 is displaced in the direction of the optical axis. Note that, the holding member 10 may be deformed as long as the holding member 10 has a rigidity necessary to curve the LED head 5 in the longitudinal direction.

When the LED head 5 is curved in the longitudinal direction, the spring members 71 and 72 have an urging force for maintaining the state in which the first inner positioning pin 61 and the second inner positioning pin 62 abut against the first inner cylindrical abutment portion and the second inner cylindrical abutment portion 32, respectively (positioned state).

When the holding member 10 is moved in the direction of the optical axis so as to be spaced away from the photosensitive drum 1, the center portion of the LED head 5 moves in the direction of the optical axis so as to be spaced away from the photosensitive drum 1. At this time, both the longitudinal end portions of the LED head 5 are urged by the spring members 71 and 72, and hence the first inner positioning pin 61 and the second inner positioning pin 62 are maintained in the state of abutting against the first inner cylindrical abutment portion 31 and the second inner cylindrical abutment portion 32, respectively. Both the end portions of the LED head 5 are maintained in the positioned state.

Both the end portions of the LED head 5 are fixed and the center portion of the LED head 5 moves in the direction in which the center portion is spaced away from the photosensitive drum 1. Accordingly, the LED head 5 has such a curved shape that the center portion thereof protrudes in the direction in which the center portion is spaced away from the photosensitive drum 1.

On the other hand, when the holding member 10 is moved in the direction of the optical axis so as to approach the photosensitive drum 1, the center portion of the LED head 5 moves in the direction of the optical axis so as to approach the photosensitive drum 1. At this time, at both the longitudinal end portions of the LED head 5, the first inner positioning pin 61 and the second inner positioning pin 62 are maintained in the state of abutting against the first inner cylindrical abutment portion 31 and the second inner cylindrical abutment portion 32, respectively. Both the end portions of the LED head 5 are maintained in the positioned state. When the projecting portion 5*b* provided at the center portion of the LED head 5 is pressed by the holding member 10, the LED head 5 has such a curved shape that the center portion thereof protrudes in the direction in which the center portion approaches the photosensitive drum 1.

As described above, the holding member 10 is moved in the direction of the optical axis, with the result that the center portion of the LED head 5 can be positioned relative to the photosensitive drum 1.

The positioning of the holding member 10 in the direction of the optical axis will be described below.

At both longitudinal end portions of the holding member 10, the first outer positioning pin (second positioning member) 91 and the second outer positioning pin (second positioning member) 92 are provided, respectively. The first inner positioning pin 61 and the second inner positioning pin 62 of the LED head 5 are arranged between the first outer positioning pin 91 and the second outer positioning pin 92 of the holding member 10. The first outer positioning pin 91 and the second outer positioning pin 92 position the holding member 10 relative to the photosensitive drum 1 so as to position the LED head 5 relative to the photosensitive drum 1 at the projecting portion (mounting portion) 5*b* of the LED head 5.

The first outer positioning pin 91 is provided at one longitudinal end portion of the holding member 10. The second outer positioning pin 92 is provided at the other longitudinal end portion of the holding member 10. The first outer positioning pin 91 and the second outer positioning pin 92 protrude from the holding member 10 in the direction of the optical axis, and abut against the first outer cylindrical abutment portion 33 and the second outer cylindrical abutment portion 34, respectively. The protrusion amount of the first outer positioning pin 91 and the protrusion amount of the second outer positioning pin 92 are each adjustable. The first outer positioning pin 91 and the second outer positioning pin 92 are inserted from one end portions of through holes (not shown) provided at both the end portions of the holding member 10, respectively.

Adjusting screws (second adjusting members) 131 and 132 are provided at other end portions of the through holes (not shown), respectively. The adjusting screws 131 and 132 are rotated and accordingly the first outer positioning pin 91 and the second outer positioning pin 92 are vertically moved independently. Thus, the protrusion amount of the first outer positioning pin 91 and the protrusion amount of the second outer positioning pin 92 are adjusted independently.

At the center portion of the holding member 10, the spring member (second elastic member) 12 is provided. The spring member 12 urges the holding member 10 toward the photosensitive drum 1 so as to maintain the positioned state of the first outer positioning pin 91 and the second outer positioning pin 92. The spring member 12 is provided on the holding member 10 in the vicinity of the projecting portion (mounting portion) 5*b* of the LED head 5. The spring member 12 is arranged between the holding member 10 and the support member (not shown) provided in the main body of the image forming apparatus 100 so as to support the LED head 5.

The spring member 12 urges the holding member 10 toward the photosensitive drum 1 so that the first outer positioning pin 91 and the second outer positioning pin 92 abut against the first outer cylindrical abutment portion 33 and the second outer cylindrical abutment portion 34, respectively. Accordingly, at both the end portions of the holding member 10, the distance between the photosensitive drum 1 and the holding member 10 is set to a second setting value (second distance).

When the distance between the photosensitive drum 1 and the holding member 10 is set to the second setting value, at the center portion of the LED head 5, the distance in the direction of the optical axis between the LED 51*a* and the surface of the photosensitive drum 1 is set within the allowable range of the conjugation length Tc, which is 9.9 millimeters with a margin of error of ±50micrometers. Thus, the center portion of the LED head 5 is positioned with high accuracy in the direction of the optical axis relative to the photosensitive drum 1.

Note that, the setting values of the distance between the photosensitive drum 1 and the holding member 10 at both the end portions of the holding member 10 may vary as long as the position of the center portion of the LED head 5 is set within the allowable range.

The first outer positioning pin 91 and the second outer positioning pin 92 abut against the first outer cylindrical abutment portion 33 and the second outer cylindrical abutment portion 34, respectively, with an appropriate pressing force caused by the spring member 12. Thus, the deviation due to an initial error at the time of assembly that is caused by the adverse effects such as a tolerance on components is corrected with high accuracy, with the result that the holding member 10 can be positioned relative to the photosensitive drum 1.

The first outer positioning pin 91 and the second outer positioning pin 92 can be always maintained in the state of abutting against the first outer cylindrical abutment portion 33 and the second outer cylindrical abutment portion 34, respectively, by the spring member 12. With the configuration in which the abutting state is maintained by the spring member 12, the positioned state is not easily affected by the disturbance such as vibrations, physical distribution, and endurance, and the distance between the photosensitive drum 1 and the holding member 10 can be maintained at the second setting value with high accuracy over a long period of time.

The adjusting screws 131 and 132 are rotated in the state in which the first outer positioning pin 91 and the second outer positioning pin 92 abut against the first outer cylindrical abutment portion 33 and the second outer cylindrical abutment portion 34, respectively, by the spring member 12. Through the rotation of the adjusting screws 131 and 132, the center portion of the LED head 5 is displaced in the direction of the optical axis. Accordingly, at the center portion of the LED head 5, the distance between the photosensitive drum 1 and the center portion of the LED head 5 is set to the first setting value (first distance).

When the distance between the photosensitive drum 1 and the center portion of the LED head 5 is set to the first setting value, the distance in the direction of the optical axis between the LED 51*a* and the surface of the photosensitive drum 1 is set within the allowable range of the conjugation length Tc, which is 9.9 millimeters with a margin of error of ±50 micrometers. Thus, the center portion of the LED head 5 is positioned with high accuracy in the direction of the optical axis relative to the photosensitive drum 1.

Accordingly, the LED head 5 can be positioned with high accuracy so that the distance in the direction of the optical axis between the LED head 5 and the photosensitive drum 1 becomes uniform over the entire longitudinal range of the LED head 5.

In this embodiment, the spring member 12 is a coil spring. However, an elastic member such as a flat spring, a rubber member, and a foamed member may be used in lieu of the coil spring.

As described above, the center portion of the LED head 5 is fixed to the holding member 10, and the adjusting members (adjusting screws 121, 122, 131, and 132) for positioning are provided at both the end portions of the LED head 5 and both the end portions of the holding member 10. Accordingly, the positions of the LED head 5 in the direction of the optical axis at both the longitudinal end portions and the longitudinal center portion of the LED head 5 can be adjusted independently. When the strength of the holding member 10, in particular, the rigidity of the holding member 10 in the direction of the optical axis, is set sufficiently high, the curvature adjustment of the LED head 5 in the direction of the optical axis can be performed by the above-mentioned method.

With the curvature adjustment of the LED head 5, the LED head 5 can be positioned with high accuracy so that the change in the longitudinal direction in distance in the direction of the optical axis between the LED head 5 and the photosensitive drum 1 is reduced over the entire longitudinal range of the LED head 5.

At both the end portions of the LED head 5, the first inner positioning pin 61 and the second inner positioning pin 62 are maintained in the state of abutting against the first inner cylindrical abutment portion 31 and the second inner cylindrical abutment portion 32, respectively, by the spring members 71 and 72. The position of the center portion of the LED head 5 is maintained by the holding member 10 via the screw 11. At both the end portions of the holding member 10, the first outer positioning pin 91 and the second outer positioning pin 92 are maintained in the state of abutting against the first outer cylindrical abutment portion 33 and the second outer cylindrical abutment portion 34, respectively, by the spring member 12.

With the configuration in which the abutting state is maintained by the spring members 71, 72, and 12, the positioned states of the LED head 5 and the holding member 10 are not easily affected by the disturbance such as vibrations, physical distribution, and endurance, and the position of the LED head 5 relative to the photosensitive drum 1 can be ensured with high accuracy over a long period of time.

The positioning method for the LED head 5 and the holding member 10 is not limited to the above-mentioned method. The method only needs to enable independent adjustment of the distance in the direction of the optical axis between the LED head 5 and the photosensitive drum 1, and the distance in the direction of the optical axis between the photosensitive drum 1 and the holding member 10, which is fastened at the substantially center portion of the LED head 5. Further, the holding method for the LED head 5 by the holding member 10 is not limited to the fixing with the screw 11, and a holding method through adhesion or a holding method with a flat spring may be employed instead. Further, the position at which the LED head 5 is held by the holding member 10 is not limited to the longitudinal center portion of the LED head 5, and may be any position in the region sandwiched between the positioning pins at both the end portions of the LED head 5.

(Second Embodiment)

Figure 11A:
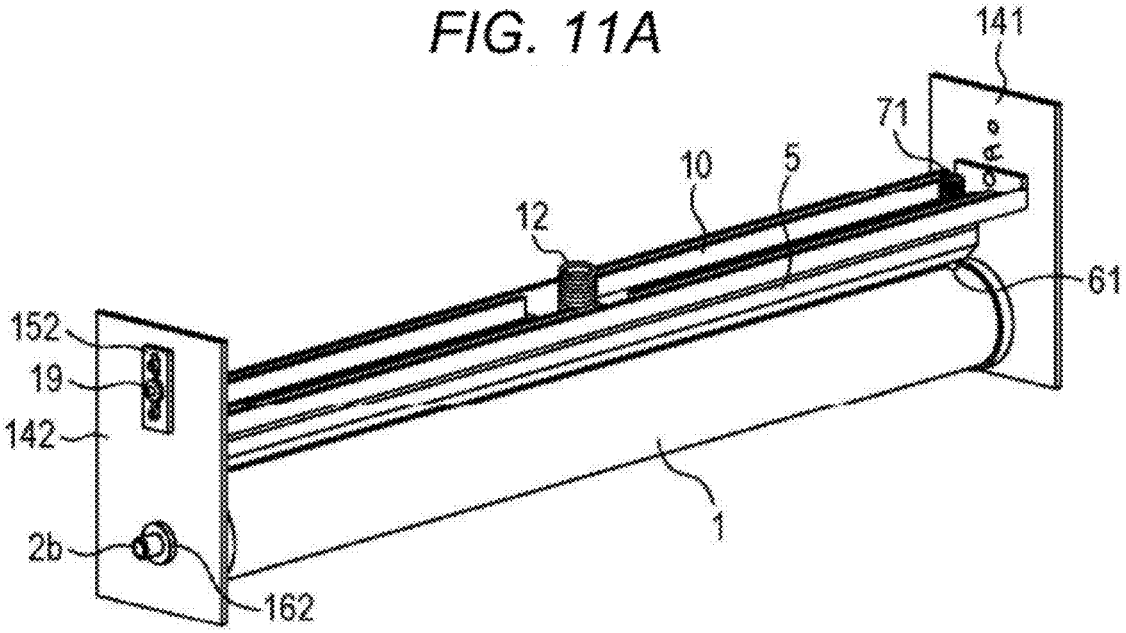
FIGS. 11A and 11B are views illustrating a positioning portion which positions the LED head relative to the photosensitive drum according to a second embodiment of the present invention.
Figure 11B:
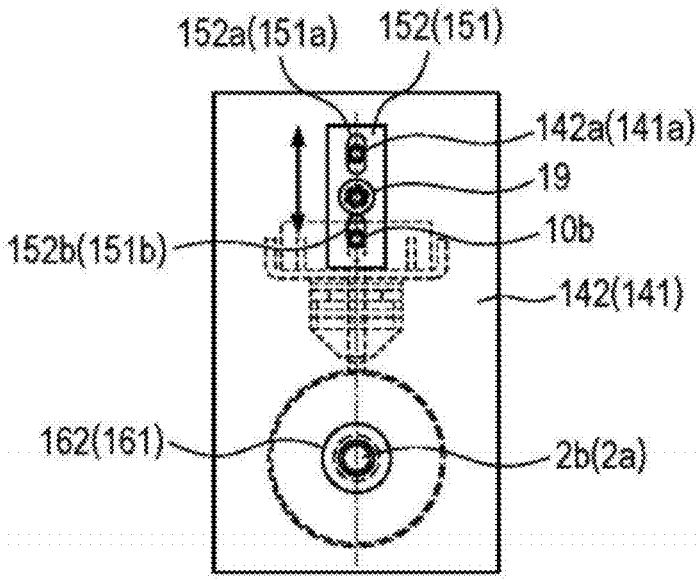

FIGS. 11A and 11B are views illustrating a positioning portion which positions the LED head 5 relative to the photosensitive drum 1 according to a second embodiment of the present invention. FIG. 11A is a perspective view of the positioning portion which positions the LED head 5 relative to the photosensitive drum 1 according to the second embodiment. FIG. 11B is a front view illustrating the positioning portion which positions the holding member 10.

In the second embodiment, components similar to those in the first embodiment are represented by similar reference symbols, and description thereof is therefore omitted herein.

In the first embodiment, the first inner positioning pin 61 and the second inner positioning pin 62 abut against the first inner cylindrical abutment portion 31 provided on the rotation shaft 2*a* and the second inner cylindrical abutment portion 32 provided on the rotation shaft 2*b*, respectively. In contrast, in the second embodiment, the first inner cylindrical abutment portion 31 and the second inner cylindrical abutment portion 32 are omitted, and the first inner positioning pin 61 and the second inner positioning pin 62 directly abut against the surface of the photosensitive drum 1.

Further, in the first embodiment, the first outer positioning pin 91 and the second outer positioning pin 92 abut against the first outer cylindrical abutment portion 33 provided on the rotation shaft 2*a* and the second outer cylindrical abutment portion 34 provided on the rotation shaft 2*b*, respectively. In contrast, in the second embodiment, the first outer positioning pin 91, the second outer positioning pin 92, the first outer cylindrical abutment portion 33, and the second outer cylindrical abutment portion 34 are omitted, and the position of the holding member 10 is adjusted by adjusting plates 151 and 152.

Components other than the above-mentioned components in the second embodiment are similar to those in the first embodiment, and description thereof is therefore omitted herein.

As illustrated in FIG. 11A, the rotation shaft 2*b*(2*a*) of the photosensitive drum 1 is rotatably supported by a side plate 142 (141) via a bearing portion 162 (161). The adjusting plate 152 (151) is provided with two elongated holes 152*a* and 152*b* (151*a* and 151*b*). A pin 142*a* (141*a*) provided on the side plate 142 (141) is inserted into the elongated hole 152*a* (151*a*) of the adjusting plate 152 (151). Accordingly, the adjusting plate 152 (151) is movable in the direction of the optical axis.

A pin 10*b* provided at each end portion of the holding member 10 is inserted into the elongated hole 152*b* (151*b*) of the adjusting plate 152 (151). Accordingly, when the adjusting plate 152 (151) is moved in the direction of the optical axis, the holding member 10 moves in the direction of the optical axis together with the adjusting plate 152 (151).

In the second embodiment, the position of the adjusting plate 152 (151) is adjusted relative to the bearing portion 162 (161) provided coaxially with the rotation shaft 2*b* (2*a*) of the photosensitive drum 1, to thereby reduce the adverse effects of the tolerance on components to the extent possible.

The adjusting plate 152 (151) is moved in the direction of the optical axis relative to the side plate 142 (141), and accordingly the distance in the direction of the optical axis between the holding member 10 and the photosensitive drum 1 can be adjusted. After the distance between the holding member 10 and the photosensitive drum 1 is adjusted, the adjusting plate 152 (151) is fixed to the side plate 142 (141) with a screw 19. The positioning pins 61 and 62 are held in direct contact with the surface of the photosensitive drum 1.

Next, an adjusting method for the imaging position according to the first and second embodiments will be described.

A coarse image, that is, a highly grainy image, which is generated when the imaging position deviates, contains many low-frequency components easily recognizable in terms of visual characteristics (VTF). The image in the best focus state contains a single dot and a plurality of dots, but the dots are stably reproduced so that the image contains many high-frequency components. Thus, the image is not recognized as a highly grainy image. Utilizing the difference in graininess, determination can be performed on whether or not the distance in the direction of the optical axis between the LED 51*a* and the surface of the photosensitive drum 1 falls within the allowable range of the conjugation length Tc.

In this embodiment, as an evaluation method for graininess, a method involving fast Fourier transform (FFT) and VTF filtering is employed. A medium tone patch image is read and the read image is output as a 600 dpi RGB signal, and the output signal is converted into a grayscale. As a conversion method, based on a complementary color relationship, the output signal is converted into a grayscale so that a red signal, a green signal, and a blue signal are extracted for cyan, magenta, and yellow, respectively. A green signal containing many signal components in terms of spectral characteristics is extracted for black.

The patch image converted as the grayscale is then converted into frequency components through the FFT processing. The VTF filtering is performed on the frequency components so as to cut off visually unrecognizable high-frequency components. The frequency components resulting from cutting off the high-frequency components are subjected to inverse fast Fourier transform (IFFT) so that an actual image is restored, and a standard deviation is determined, with the result that the graininess of the image can be determined. Through the sequential work, the image is highly grainy as in the defocus state and has a high unevenness, and hence the value of the standard deviation is high and the value of the graininess is high.

Figure 12A:
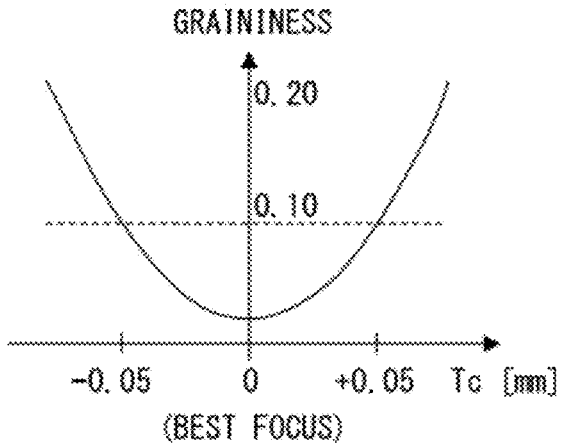
FIG. 12A is a graph showing a relationship between a defocus amount and graininess.

When the medium tones are output, the single dot and the plurality of dots are mixed with balance, and as in the case of the printer output characteristics shown in FIG. 8, the change in density in the image exhibits a steep gradation. Therefore, when the medium tone patch is output as an evaluation sample, it is possible to obtain a result of a relationship of the graininess relative to the conjugation length as shown in FIG. 12A. When the detected graininess exhibits a value exceeding 0.10, which falls out of the allowable range of the conjugation length Tc, that is, ±50 micrometers, it can be determined that the image forming apparatus is in the defocus state.

At the time of initial adjustment, the position of the LED head 5 relative to the photosensitive drum 1 is adjusted so that the values of the graininess are substantially minimized at both end portions and a center portion of the image in a main scanning direction, which is the longitudinal direction of the LED head 5.

The adjusting method for the imaging position is not limited to the above-mentioned method. For example, a light intensity sensor such as a CCD sensor and a photodiode may be arranged at a position corresponding to the surface of the photosensitive drum 1, and the adjustment may be performed using an assembly tool.

Figure 12B:
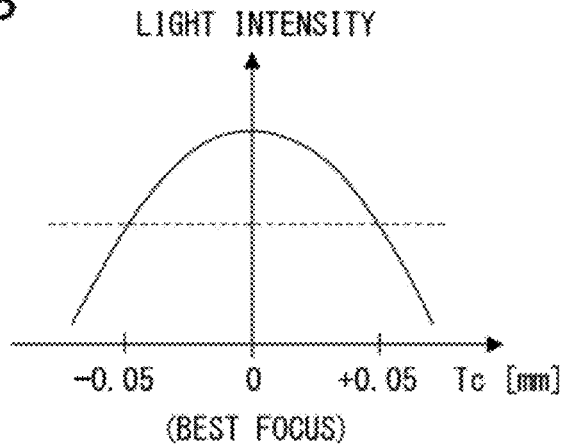
FIG. 12B is a graph showing a relationship between the defocus amount and light intensity.

When the defocus state is obtained by moving the position of the LED head 5 in the direction of the optical axis relative to the light intensity sensor, based on a relationship of the light intensity relative to the conjugation length as shown in FIG. 12B, the light intensity sensor detects a change in light intensity in accordance with the defocusing of the LED head 5. Then, the protrusion amounts of the positioning pins 61 and 62 of the LED head 5 and the protrusion amounts of the positioning pins 91 and 92 of the holding member 10 may be adjusted or the adjusting plate 152 (151) may be adjusted so that the values of the light intensity are substantially maximized at the longitudinal center portion and both the longitudinal end portions of the LED head 5.

There may be provided an automatic focus adjusting mechanism for automatically changing, using the above-mentioned information on the graininess, the position of the LED head 5 so that the value of the graininess does not exceed the specified value 0.10. In this embodiment, it is possible to provide stable image quality through the lapse of time even when the automatic focus adjusting mechanism is not provided.

Note that, the light emitting element is not limited to the LED. For example, a plurality of light sources such as organic EL elements may be arranged side-by-side in a direction orthogonal to the rotational direction of the photosensitive drum 1. Further, the imaging element is not limited to the rod lens array having the optical characteristics of erecting equal-magnification imaging. For example, a plurality of lenses having optical characteristics to form an inverted image or an image at unequal magnification, such as microlenses, may be arranged side-by-side along the arrangement direction of the plurality of light sources.

With the configuration described above, the positioning of the LED head 5 can be adjusted with high accuracy over the entire longitudinal range thereof, and stable image quality with no coarseness can be provided over a long period of time.

(Third Embodiment)

A third embodiment of the present invention is different from the first embodiment in that a device which corrects a total magnification in the main scanning direction through rotation of the LED head 5, and a correction circuit which corrects an exposure position through adjustment of light emission timings of the plurality of LEDs 51*a* are provided. Other components in the third embodiment are similar to those in the first embodiment, and description thereof is therefore omitted herein.

In this embodiment, the LED head 5 is rotatable in a sub-scanning direction perpendicular to the main scanning direction, and hence the total magnification in the main scanning direction can be corrected.

In general, as a method of correcting the total magnification in the main scanning direction, for example, there is a method of converting image data and increasing and decreasing the number of LEDs to be used. In this method, the correction resolution is set on a pixel-by-pixel basis, and hence the correction cannot be performed at a resolution of a light emitting point interval of the LEDs or less. For 600 dpi, the light emitting point interval of the LEDs is about 42 micrometers, and hence the correction resolution of the total magnification is about micrometers. Similarly, for 1,200 dpi, the light emitting point interval of the LEDs is about 21 micrometers, and hence the correction resolution of the total magnification is about 21 micrometers.

In an image forming apparatus of the tandem type, a residual error due to the resolution of the correction of the total magnification causes image defects such as color misregistration and color unevenness.

However, also from the viewpoint of recent progress in image quality, the color misregistration is required to be suppressed at an amount corresponding to one pixel or less. Therefore, a correction resolution of one pixel or less is necessary for the correction of the total magnification. Therefore, in this embodiment, as described above, the LED head 5 is pivoted in the sub-scanning direction for the correction of the total magnification so that the correction at a magnification of one pixel or less is enabled.

Japanese Patent Application Laid-Open No. 2006-082522 discloses that the LED head 5 is rotated for the correction of the total magnification.

Figure 13:
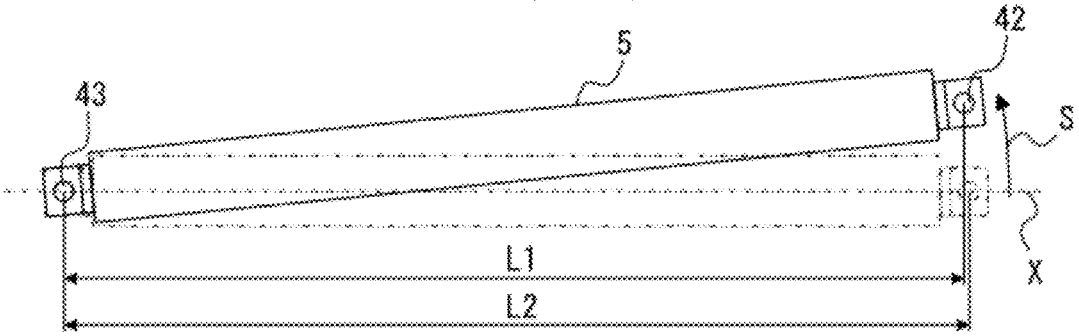
FIG. 13 is an explanatory view illustrating a magnification correction method according to a conventional technology.

According to Japanese Patent Application Laid-Open No. 2006-082522, as illustrated in FIG. 13, the one end portion of the LED head 5 is rotated in a direction indicated by the arrow S about a shaft 43 provided at one end portion of the LED head 5. The LED head 5 has an exposure width L2 between a shaft 42 and the shaft 43 in the main scanning direction (direction along the axis X of the photosensitive drum 1). Through the rotation of the LED head 5, the exposure width between the shaft 42 and the shaft 43 of the LED head 5 in the main scanning direction decreases to L1.

As described above, the exposure width of the LED head 5 in the main scanning direction is changed from L2 to L1, to thereby perform the correction of the total magnification. The correction of the total magnification is performed using all the LEDs, and hence the resolution does not decrease. Further, it is possible to perform more precise adjustment as compared to the adjustment on the LED-by-LED basis.

Note that, when the LED head 5 is rotated, the longitudinal direction of the LED head 5 is inclined relative to the main scanning direction, and hence the exposure position deviates. However, through adjustment of the exposure timings of the plurality of LEDs 51*a* of the LED head 5 in accordance with the rotation amount of the LED head 5, the exposure position on the photosensitive drum 1 can be corrected, and hence the image is not formed askew.

Adverse effects of the deviation of the imaging position due to the rotation of the LED head 5 will be described below.

Through the adjustment of the exposure timings of the LEDs 51*a*, the exposure position on the photosensitive drum 1 can be corrected. However, due to the rotation of the LED head 5, the distance in the direction of the optical axis between the LED (light emitting point LP) 51*a* and the surface of the photosensitive drum 1 (image surface IS) may fall out of the allowable range of the conjugation length Tc.

Figure 14A:
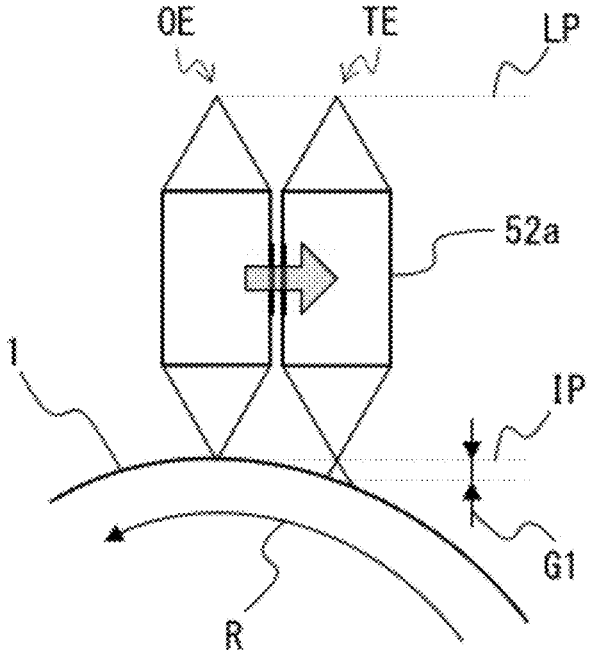
FIGS. 14A and 14B are explanatory views illustrating deviation of an imaging position caused by rotation of the LED head.

For example, as illustrated in FIG. 13, when the LED head 5 is rotated in the direction indicated by the arrow S for the correction of the total magnification, as illustrated in FIG. 14A, the distance between the surface of the photosensitive drum 1 and the LED (light emitting point LP) 51*a* of the LED head 5 deviates by an amount corresponding to the curvature of the photosensitive drum 1.

FIG. 14A is an explanatory view illustrating deviation of an imaging position IP occurring when the LED head 5 is rotated about one end portion OE of the LED head 5. At the one end portion OE as a rotational center of the LED head 5, the imaging position IP is situated on the surface of the photosensitive drum 1. However, at the other end portion TE of the LED head 5, deviation G1 by an amount corresponding to the curvature of the photosensitive drum 1 occurs in the distance between the surface of the photosensitive drum 1 and the LED (light emitting point LP) 51*a* of the LED head 5, and hence the imaging position IP is spaced away from the surface of the photosensitive drum 1.

Figure 14B:
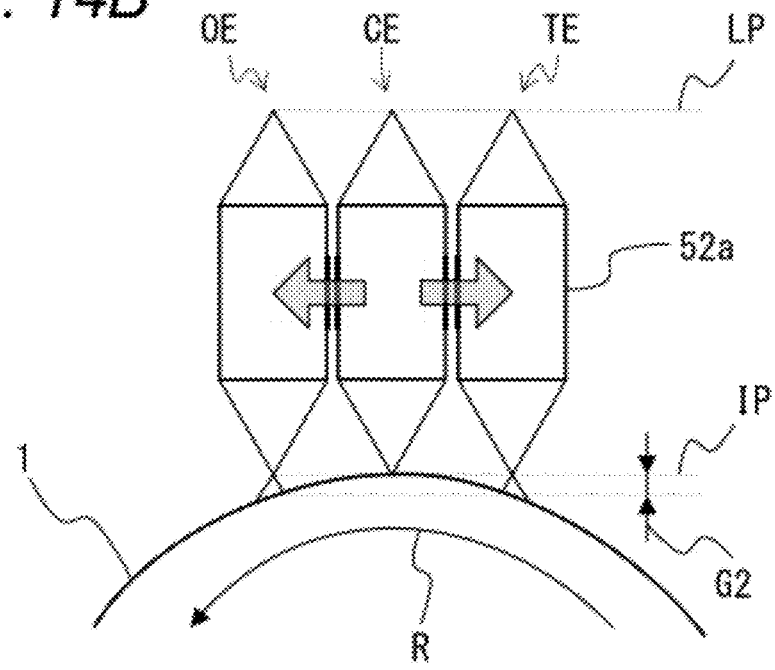

In the third embodiment, the rotational center of the LED head 5 is provided at a longitudinal center portion CE of the LED head 5. FIG. 14B is an explanatory view illustrating deviation of the imaging position IP occurring when the LED head 5 is rotated about the center portion CE of the LED head 5. At the center portion CE as the rotational center of the LED head 5, the imaging position IP is situated on the surface of the photosensitive drum 1. However, at both the end portions of the LED head 5 (one end portion OE and the other end portion TE), deviation G2 by an amount corresponding to the curvature of the photosensitive drum 1 occurs in the distance between the surface of the photosensitive drum 1 and the LED (light emitting point LP) 51*a* of the LED head 5, and hence the imaging position IP is spaced away from the surface of the photosensitive drum 1.

Next, a relationship between a correction amount of the total magnification and a deviation amount of the imaging position of the LED head 5 will be described.

Figure 15A:
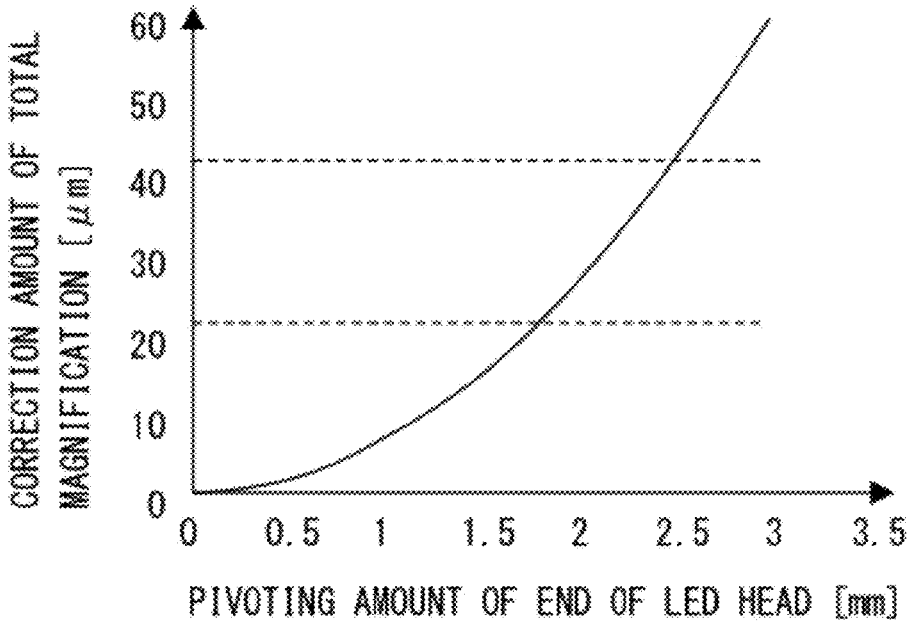
FIG. 15A is a graph showing a relationship between a pivoting amount of an end portion of the LED head and a correction amount of total magnification.

FIG. 15A is a graph showing a relationship between a pivoting amount of the end portions of the LED head 5 and the correction amount of the total magnification. First, correction of the total magnification at a resolution of one pixel or less at 600 dpi is discussed. For supplementary description, magnification correction at a resolution of one pixel or more can be performed in combination with the conversion of image data, and hence the case of one pixel or less will be discussed herein.

In the correction of the total magnification at a resolution of one pixel or less at 600 dpi, a correction amount of up to about 42 micrometers is expected. When the center portion CE of the LED head 5 is set as the rotational center, as can be seen from FIG. 15A, pivoting amounts of both the end portions OE and TE of the LED head 5 necessary for the correction of the total magnification of 42 micrometers are about 2.5 millimeters. Similarly, in the correction of the total magnification at a resolution of one pixel or less at 1,200 dpi, magnification correction of up to about 21 micrometers is expected. In this case, as can be seen from FIG. 15A, necessary pivoting amounts of both the end portions OE and TE of the LED head 5 are about 1.8 millimeters.

Figure 15B:
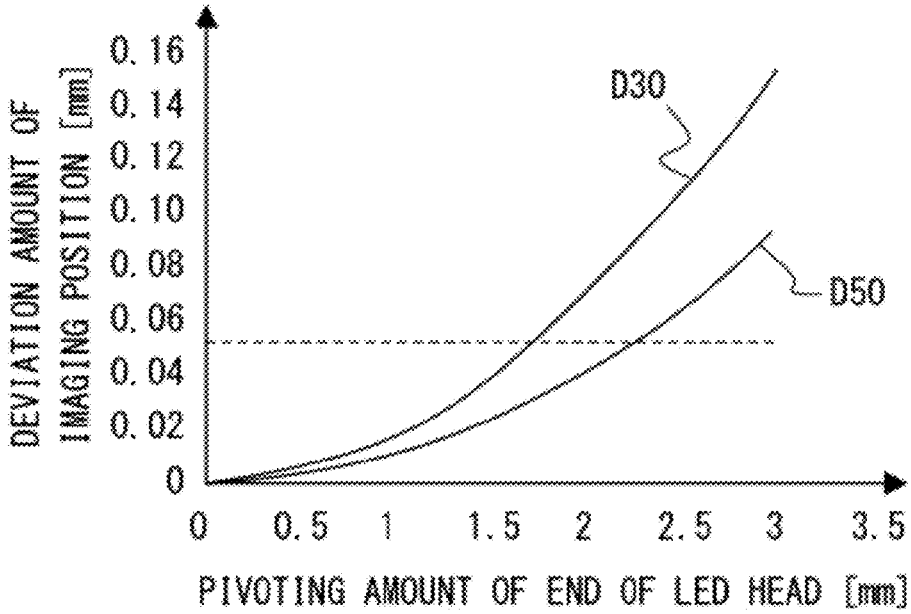
FIG. 15B is a graph showing a relationship between the pivoting amount of the end portion of the LED head and a deviation amount of the imaging position.

FIG. 15B is a graph showing a relationship between the pivoting amount of the end portions OE and TE of the LED head 5 and the deviation amount of the imaging position. FIG. 15B shows a curve D30 in a case where the photosensitive drum 1 has a diameter of 30 millimeters, and a curve D50 in a case where the photosensitive drum 1 has a diameter of 50 millimeters.

Considering the correction of the total magnification at a resolution of one pixel or less at 600dpi, the maximum pivoting amounts of both the end portions OE and TE of the LED head 5 are about 2.5 millimeters. As can be seen from FIG. 15B, in the case where the photosensitive drum 1 has a diameter of 30 millimeters, the deviation amount of the imaging position is about 0.10 millimeters, and in the case where the photosensitive drum 1 has a diameter of 50 millimeters, the deviation amount of the imaging position is about 0.06 millimeters.

Similarly, considering the correction of the total magnification at a resolution of one pixel or less at 1,200 dpi, the maximum pivoting amounts of both the end portions OE and TE of the LED head 5 are about 1.8millimeters. As can be seen from FIG. 15B, in the case where the photosensitive drum 1 has a diameter of 30millimeters, the deviation amount of the imaging position is about 0.05 millimeters, and in the case where the photosensitive drum 1 has a diameter of 50 millimeters, the deviation amount of the imaging position is about 0.03millimeters.

Figure 16:
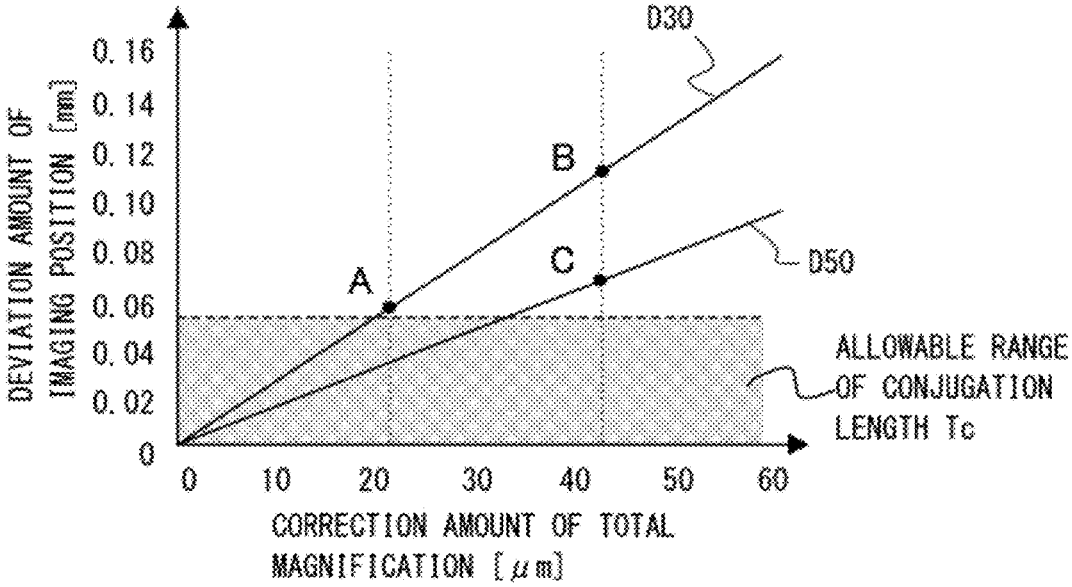
FIG. 16 is a graph showing a relationship between the correction amount of the total magnification and the deviation amount of the imaging position.

FIG. 16 is a graph showing the relationship between the correction amount of the total magnification and the deviation amount of the imaging position. The relationship between the correction amount of the total magnification and the deviation amount of the imaging position shown in FIG. 16 is obtained based on the relationship between the pivoting amount of the end portions OE and TE of the LED head 5 and the correction amount of the total magnification shown in FIG. 15A, and the relationship between the pivoting amount of the end portions OE and TE of the LED head 5 and the deviation amount of the imaging position shown in FIG. 15B.

The point A of FIG. 16 indicates a deviation amount of the imaging position at the time of performing the correction of the total magnification at a resolution of one pixel or less at 1,200 dpi in the case where the photosensitive drum 1 has a diameter of 30 millimeters. The point B indicates a deviation amount of the imaging position at the time of performing the correction of the total magnification at a resolution of one pixel or less at 600 dpi in the case where the photosensitive drum 1 has a diameter of 30 millimeters. The point C indicates a deviation amount of the imaging position at the time of performing the correction of the total magnification at a resolution of one pixel or less at 600 dpi in the case where the photosensitive drum 1 has a diameter of 50 millimeters. As shown in FIG. 16, the points A, B, and C fall out of the allowable range of the conjugation length Tc, that is, ±50 micrometers (±0.05 millimeters), which is described in the first embodiment.

That is, when the LED head 5 is rotated for the correction of the total magnification, it is necessary to correct the deviation amount of the imaging position at the same time.

Figure 17A:
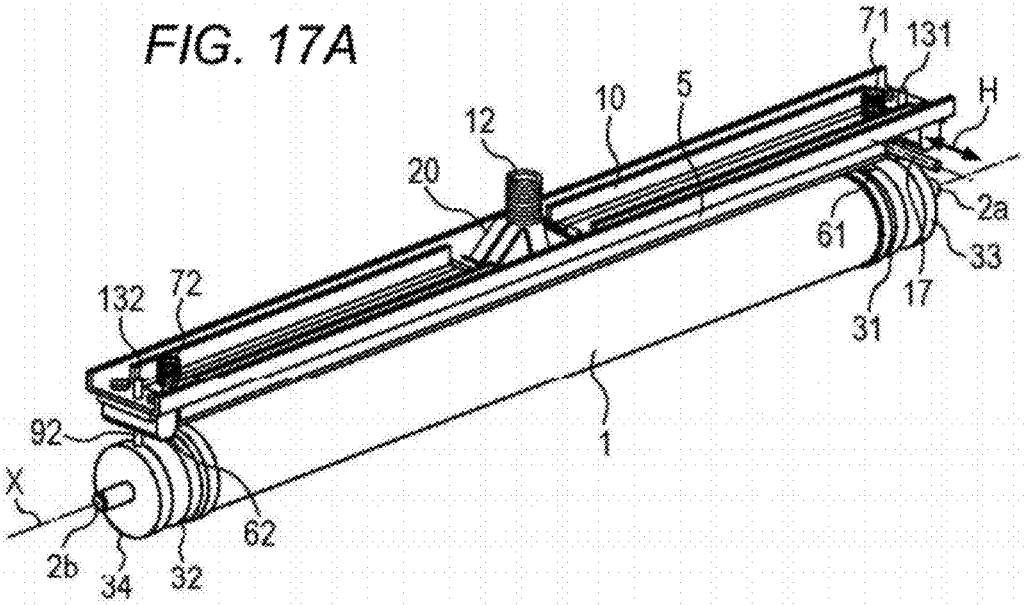
FIGS. 17A and 17B are perspective views of a positioning portion which positions the LED head relative to the photosensitive drum according to a third embodiment of the present invention.
Figure 17B:
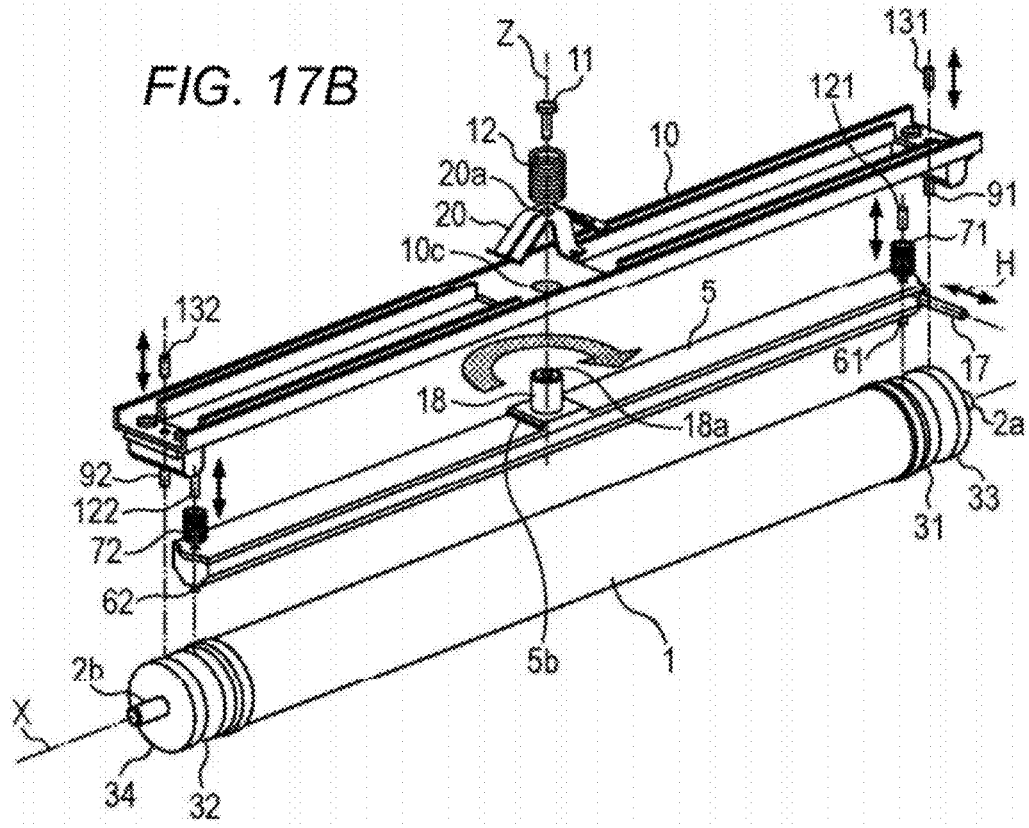

FIGS. 17A and 17B are perspective views of a positioning portion which positions the LED head 5 relative to the photosensitive drum 1 according to the third embodiment. The positioning portion which positions the LED head 5 relative to the photosensitive drum 1 has a configuration similar to that in the first embodiment. Components similar to those in the first embodiment are represented by reference symbols similar to those in the first embodiment, and description thereof is therefore omitted herein. The third embodiment is different from the first embodiment in that the LED head 5 is set rotatable relative to the holding member 10 about a rotational center set as a holding portion, at which the holding member 10 holds the LED head 5.

A shaft member 18 is provided to the projecting portion 5*b* (mounting portion) at the substantially longitudinal center portion of the LED head 5. An axis Z of the shaft member 18 is parallel to the direction of the optical axis of the LED head 5. Further, the axis Z of the shaft member 18 is perpendicular to the axis X of the photosensitive drum 1. The shaft member 18 is rotatably inserted into a hole 10*c* provided in the substantially longitudinal center portion of the holding member 10. The LED head 5 is rotatable relative to the holding member 10 about the shaft member 18.

A flat spring (elastic member) 20 is provided in contact with an end portion of the shaft member 18 and a top surface of the holding member 10. The screw 11 engages with a threaded hole 18*a* provided in the shaft member 18 through a hole 20*a* provided in the flat spring 20 so that the flat spring 20 is fixed to the shaft member 18. The flat spring 20 urges, at any time, the holding member 10 toward the LED head 5 so that the contact between the holding member 10 and the projecting portion 5*b* of the LED head 5 is not released. However, the flat spring 20 allows the LED head 5 to rotate relative to the holding member 10.

The spring member 12 is arranged between the flat spring 20 and the support member (not shown) provided on the main body of the image forming apparatus 100 so as to support the LED head 5. The spring member 12 urges the holding member 10 toward the photosensitive drum 1.

The holding member 10 is supported by the support member (not shown) provided in the main body of the image forming apparatus 100 so as not to rotate in a plane orthogonal to the direction of the optical axis. The LED head 5 is held by the holding member 10 so as to rotate about the shaft member 18 in a plane orthogonal to the optical axis.

With the flat spring 20, only the LED head 5 can be rotated independently relative to the holding member 10 while preventing the rotation of the holding member 10.

A magnification adjusting pin (rotation amount adjusting member) 17 is arranged in the vicinity of the one longitudinal end portion of the LED head 5. When the LED head 5 is rotated, the one end portion of the LED head 5 moves in a pivoting direction indicated by the arrow H. The magnification adjusting pin 17 is movable in the pivoting direction indicated by the arrow H.

The LED head 5, the photosensitive drum 1, and the holding member 10 are adjusted so that the longitudinal axes thereof are normally aligned in parallel.

When the total magnification of the LED head 5 is corrected, the magnification adjusting pin 17 is moved in the pivoting direction indicated by the arrow H. A tip end portion of the magnification adjusting pin 17 abuts against a side surface of the LED head 5 at the one longitudinal end portion thereof, and the magnification adjusting pin 17 pushes the one end portion of the LED head to move the LED head in the pivoting direction. The LED head 5 rotates relative to the holding member 10 about the shaft member 18. The LED head 5 rotates in accordance with a movement amount (protrusion amount) of the magnification adjusting pin 17 so that the exposure width of the LED head 5 in the main scanning direction is adjusted. Accordingly, the total magnification of the LED head 5 is corrected.

In the conventional technology, when the LED head 5 is rotated, at both the end portions of the LED head 5, the distance between the surface of the photosensitive drum 1 and the LED (light emitting point LP) 51*a* of the LED head increases by an amount corresponding to the curvature of the photosensitive drum 1. Therefore, as illustrated in FIGS. 14A and 14B, at both the end portions of the LED head 5, the imaging position is spaced away from the surface of the photosensitive drum 1.

In contrast, according to the third embodiment, as described in the first embodiment, both the end portions of the LED head 5 are urged by the spring members 71 and 72. With the urging force of the spring members 71 and 72, both the end portions of the LED head 5 are displaced by an amount corresponding to the curvature of the first inner cylindrical abutment portion 31 and the second inner cylindrical abutment portion 32, that is, toward the photosensitive drum 1.

With the urging force of the spring members 71 and 72, the first inner positioning pin 61 and the second inner positioning pin 62 always abut against the first inner cylindrical abutment portion 31 and the second inner cylindrical abutment portion 32, respectively. The diameter of the photosensitive drum 1 and the diameters of the first inner cylindrical abutment portion 31 and the second inner cylindrical abutment portion 32 are equal to one another, and hence, even when the LED head 5 is rotated, at both the end portions of the LED head 5, the distance between the photosensitive drum 1 and the LED head 5 is maintained at the first setting value (first distance).

Thus, at both the end portions of the LED head 5, the distance in the direction of the optical axis between the LED 51*a* and the surface of the photosensitive drum 1 is maintained within the allowable range of the conjugation length Tc, which is 9.9 millimeters with a margin of error of ±50 micrometers. Thus, both the end portions of the LED head 5 are maintained in the positioned state with high accuracy in the direction of the optical axis relative to the photosensitive drum 1.

When the LED head 5 is rotated, the holding member 10 does not rotate. Thus, the distance between the holding member 10 and the photosensitive drum 1 does not change. The holding member 10 holds the LED head 5 while being pressed against the LED head 5 in the direction of the optical axis by the flat spring 20 provided at the longitudinal center portion of the holding member 10.

Even when the LED head 5 is rotated relative to the holding member 10 against a frictional force between the LED head 5 and the holding member 10, the distance between the longitudinal center portion of the LED head 5 and the holding member 10 does not change. Thus, the distance in the direction of the optical axis between the center portion of the LED head 5 and the photosensitive drum 1 can be maintained at the first setting value (first distance).

Through the rotation of the LED head 5, both the end portions of the LED head 5 are displaced toward the photosensitive drum 1, and hence the LED head 5 is shaped to curve in the direction of the optical axis in accordance with the rotation amount of the LED head 5.

According to the third embodiment, when both the end portions of the LED head 5 are pivoted in the pivoting direction (sub-scanning direction), both the end portions of the LED head 5 are displaced toward the photosensitive drum 1 in accordance with the pivoting amount of both the end portions of the LED head 5, with the result that the LED head 5 is curved in the direction of the optical axis.

Figure 18:
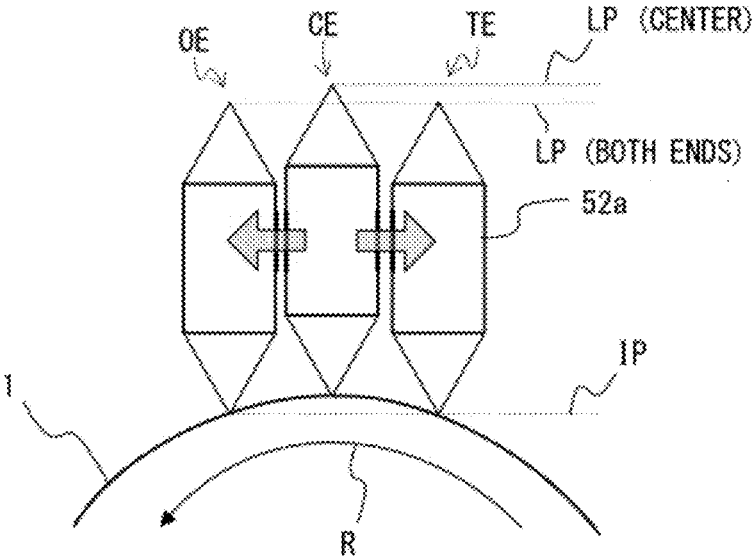
FIG. 18 is an explanatory view illustrating prevention of the deviation of an imaging position according to the third embodiment.

FIG. 18 is an explanatory view illustrating prevention of the deviation of the imaging position IP according to the third embodiment. As described above, when both the end portions OE and TE of the LED head 5 are moved in the pivoting direction (sub-scanning direction), as illustrated in FIG. 18, both the longitudinal end portions OE and TE of the LED head 5 are displaced toward the photosensitive drum 1 along the outer diameters of the cylindrical abutment portions. Thus, the distance in the direction of the optical axis between the photosensitive drum 1 and both the longitudinal end portions OE and TE of the LED head 5 does not change and is maintained at the setting value. On the other hand, even when the LED head 5 is rotated, the distance in the direction of the optical axis between the center portion CE of the LED head 5 and the photosensitive drum 1 does not change and is maintained at the setting value.

Thus, even when the LED head 5 is rotated in the plane perpendicular to the optical axis for the correction of the total magnification of the LED head 5, the distance between the photosensitive drum 1 and the LED head 5 can be maintained at the setting value with high accuracy over the entire length of the LED head 5.

According to the third embodiment, when the total magnification of the LED head 5 is corrected, the deviation of the imaging position at both the longitudinal end portions of the LED head 5 can be corrected with a simple configuration and with no need for electrical components such as a motor and an actuator.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-093635, filed Apr. 20, 2011, which is hereby incorporated by reference herein in its entirety.

What is claimed is:

1. An image forming apparatus for forming an image on a recording medium, the image forming apparatus comprising:

an image bearing member;

an exposure device including a plurality of light emitting elements arrayed along a longitudinal direction of the image bearing member so as to expose with light different positions of the image bearing member in the longitudinal direction;

first positioning members provided at both longitudinal end portions of the exposure device, and configured to position the exposure device relative to the image bearing member at both longitudinal end portions, respectively;

a first elastic member configured to urge the exposure device toward the image bearing member so as to maintain a positioned state of the first positioning members;

a holding member configured to hold the exposure device at a mounting portion between the first positioning members provided at both longitudinal end portions of the exposure device;

a second positioning member provided on the holding member, and configured to position the holding member relative to the image bearing member so as to position the exposure device relative to the image bearing member at the mounting portion;

a second elastic member configured to urge the holding member toward the image bearing member so as to maintain a positioned state of the second positioning member, a first adjusting member configured to adjust, by the first positioning members, a distance in a direction of an optical axis between the image bearing member and the exposure device at both longitudinal end portions of the exposure device; and a second adjusting member configured to adjust, by the second positioning member, a distance in the direction of the optical axis between the image bearing member and the exposure device at the mounting portion of the exposure device, wherein the holding member has a rigidity necessary to curve the exposure device in the longitudinal direction when the second adjusting member adjusts, by the second positioning member, the distance in the direction of the optical axis between the image bearing member and the exposure device at the mounting portion of the exposure device.

2. An image forming apparatus according to claim 1, wherein the first elastic member comprises first elastic members provided in the vicinity of the first positioning members at both longitudinal end portions of the exposure device, respectively, and wherein the second elastic member is provided on the holding member in the vicinity of the mounting portion.

3. An image forming apparatus according to claim 1, wherein the second positioning member comprises second positioning members provided at both longitudinal end portions of the holding member.

4. An image forming apparatus according to claim 3, wherein the first positioning members of the exposure device are arranged between the second positioning members of the holding member.

5. An image forming apparatus according to claim 1, wherein the first elastic member has an urging force for maintaining the positioned state of the first positioning members when the exposure device is curved in the longitudinal direction.

6. An image forming apparatus for forming an image on a recording medium, the image forming apparatus comprising:

an image bearing member;

an exposure device including a plurality of light emitting elements arrayed along a longitudinal direction of the image bearing member so as to expose with light different positions of the image bearing member in the longitudinal direction;

first positioning members provided at both longitudinal end portions of the exposure device, and configured to position the exposure device relative to the image bearing member at both longitudinal end portions, respectively;

a first elastic member configured to urge the exposure device toward the image bearing member so as to maintain a positioned state of the first positioning members;

a holding member configured to hold the exposure device at a mounting portion between the first positioning members provided at both longitudinal end portions of the exposure device;

a second positioning member provided on the holding member, and configured to position the holding member relative to the image bearing member so as to position the exposure device relative to the image bearing member at the mounting portion; and a second elastic member configured to urge the holding member toward the image bearing member so as to maintain a positioned state of the second positioning member, wherein the exposure device is held by the holding member so as to be rotatable in a plane orthogonal to an optical axis of the exposure device.

7. An image forming apparatus according to claim 6, further comprising a rotation amount adjusting member which adjusts a rotation amount of the exposure device.

8. An image forming apparatus according to claim 6, wherein, when the exposure device is rotated, the first elastic member displaces one or both longitudinal end portions of the exposure device toward the image bearing member in accordance with a rotation amount of the exposure device to maintain the positioned state of the first positioning members.

* * * * *